US012369641B2

(12) United States Patent
Nelson et al.

(10) Patent No.: US 12,369,641 B2
(45) Date of Patent: Jul. 29, 2025

(54) AEROSOL PROVISION SYSTEM HAVING A RESERVOIR WITH A DIVIDING WALL ELEMENT

(71) Applicant: Nicoventures Trading Limited, London (GB)

(72) Inventors: David Alan Nelson, Hampshire (GB); Steve Hughes, London (GB)

(73) Assignee: Nicoventures Trading Limited, London (GB)

( * ) Notice: Subject to any disclaimer, the term of this patent is extended or adjusted under 35 U.S.C. 154(b) by 0 days.

(21) Appl. No.: 17/929,555

(22) Filed: Sep. 2, 2022

(65) Prior Publication Data

US 2022/0408829 A1 Dec. 29, 2022

Related U.S. Application Data

(63) Continuation of application No. 17/310,697, filed as application No. PCT/GB2020/050376 on Feb. 18, 2020.

(30) Foreign Application Priority Data

Feb. 18, 2019 (GB) ..... 1902220

(51) Int. Cl.
*A24F 40/485* (2020.01)
*A24F 40/42* (2020.01)
(Continued)

(52) U.S. Cl.
CPC ..... *A24F 40/485* (2020.01); *A24F 40/42* (2020.01); *A24F 40/44* (2020.01); *A24F 40/70* (2020.01)

(58) Field of Classification Search
CPC ..... A24F 40/485; A24F 40/42; A24F 40/40
See application file for complete search history.

(56) References Cited

U.S. PATENT DOCUMENTS 3,671,920 A 6/1972 Iantomo
4,334,730 A 6/1982 Colwell
(Continued)

FOREIGN PATENT DOCUMENTS

AU 2020225438 B2 1/2023
CN 203168030 U 9/2013
(Continued)

OTHER PUBLICATIONS

"Decision to Grant received for Japanese Patent Application No. 2021-200680, mailed on Mar. 7, 2023", 5 pages (2 pages of English Translation and 3 pages of Official Copy Only).
(Continued)

*Primary Examiner* — Hae Moon Hyeon
(74) *Attorney, Agent, or Firm* — Merchant & Gould P.C.

(57) ABSTRACT

A cartridge for an aerosol provision system that includes the cartridge and a control unit. The cartridge includes an air channel extending from an air inlet for the cartridge to an outlet via an aerosol generation region; a heating element for heating aerosolizable material, such as liquid, from a reservoir to generate aerosol in the aerosol generation region; and a valve located in the air channel upstream of the aerosol-generating region. The cartridge is configured such that air passing through the air channel is configured to pass from the air inlet, past the air valve, into the aerosol-generating region, and then out from the aerosol outlet.

16 Claims, 10 Drawing Sheets

(51) Int. Cl.
*A24F 40/44* (2020.01)
*A24F 40/70* (2020.01)

(56) References Cited

U.S. PATENT DOCUMENTS

| | | | | |
|---|---|---|---|---|
| 4,650,271 | A | 3/1987 | Forney, Jr. | |
| 4,662,703 | A | 5/1987 | Forney, Jr. | |
| 7,320,627 | B2 | 1/2008 | Skarlupka | |
| 7,722,413 | B2 | 5/2010 | Tonosaki | |
| 7,946,861 | B2 | 5/2011 | Sander | |
| D642,494 | S | 8/2011 | Loeb | |
| D699,156 | S | 2/2014 | Perini | |
| D775,009 | S | 12/2016 | Baum | |
| D796,997 | S | 9/2017 | Varga | |
| D802,479 | S | 11/2017 | Sakaue et al. | |
| D804,357 | S | 12/2017 | Jeon | |
| D804,369 | S | 12/2017 | Akita et al. | |
| D814,353 | S | 4/2018 | Kim et al. | |
| 10,034,495 | B2 * | 7/2018 | Alarcon | A61M 15/06 |
| D830,246 | S | 10/2018 | Yoshimine et al. | |
| D830,906 | S | 10/2018 | Yoshimine et al. | |
| D835,000 | S | 12/2018 | Tomasson et al. | |
| D864,025 | S | 10/2019 | Tomasson et al. | |
| D872,650 | S | 1/2020 | Tomasson et al. | |
| D881,755 | S | 4/2020 | Tomasson et al. | |
| D894,047 | S | 8/2020 | Tomasson et al. | |
| D906,440 | S | 12/2020 | Sterner | |
| D926,081 | S | 7/2021 | Zvenigorodskyy et al. | |
| 11,051,550 | B2 * | 7/2021 | Lin | A24F 40/46 |
| D929,904 | S | 9/2021 | Noguchi et al. | |
| D931,144 | S | 9/2021 | Sterner | |
| 11,357,257 | B2 | 6/2022 | Lin | |
| D967,731 | S | 10/2022 | Akojima | |
| D969,023 | S | 11/2022 | Sterner et al. | |
| 11,771,133 | B2 * | 10/2023 | Lin | B67D 7/0288 131/329 |
| 2013/0319438 | A1 | 12/2013 | Liu | |
| 2014/0109921 | A1 | 4/2014 | Chen | |
| 2015/0020829 | A1 | 1/2015 | Li | |
| 2015/0245658 | A1 | 9/2015 | Worm et al. | |
| 2015/0342257 | A1 | 12/2015 | Chen | |
| 2015/0351457 | A1 | 12/2015 | Liu | |
| 2016/0073694 | A1 | 3/2016 | Liu | |
| 2016/0219938 | A1 | 8/2016 | Mamoun et al. | |
| 2016/0235120 | A1 | 8/2016 | Liu | |
| 2017/0164655 | A1 | 6/2017 | Chen | |
| 2017/0258139 | A1 | 9/2017 | Rostami et al. | |
| 2018/0020730 | A1 * | 1/2018 | Alarcon | A24F 40/42 131/329 |
| 2018/0153218 | A1 | 6/2018 | Verleur et al. | |
| 2018/0213850 | A1 | 8/2018 | Brinkley et al. | |
| 2018/0296778 | A1 | 10/2018 | Hacker | |
| 2018/0310616 | A1 | 11/2018 | Clemens et al. | |
| 2019/0045834 | A1 | 2/2019 | Fuisz et al. | |
| 2019/0098931 | A1 | 4/2019 | Leadley | |
| 2019/0364972 | A1 * | 12/2019 | Lin | A24F 40/40 |

FOREIGN PATENT DOCUMENTS

| | | | |
|---|---|---|---|
| CN | 204483015 | U | 7/2015 |
| CN | 106343611 | A | 1/2017 |
| CN | 106418721 | A | 2/2017 |
| CN | 106690425 | A | 5/2017 |
| CN | 106871308 | A | 6/2017 |
| CN | 107713019 | A | 2/2018 |
| CN | 108185536 | A | 6/2018 |
| CN | 207665989 | U | 7/2018 |
| EP | 2835063 | A1 | 2/2015 |
| EP | 2517031 | B1 | 6/2016 |
| EP | 3114947 | A1 | 1/2017 |
| EP | 3170414 | A1 | 5/2017 |
| EP | 3178335 | A1 | 6/2017 |
| JP | 2014020620 | A | 2/2014 |
| JP | 2016139813 | A | 8/2016 |
| JP | 2017501805 | A | 1/2017 |
| JP | 2017085957 | A | 5/2017 |
| JP | 2017535245 | A | 11/2017 |
| JP | 2018126355 | A | 8/2018 |
| JP | 2022051572 | A | 3/2022 |
| RU | 2608298 | C2 | 1/2017 |
| RU | 2608915 | C2 | 1/2017 |
| RU | 2627002 | C2 | 8/2017 |
| RU | 2016147203 | A | 6/2018 |
| UA | 67598 | U | 2/2012 |
| WO | 2013027249 | A1 | 2/2013 |
| WO | 2013116568 | A2 | 8/2013 |
| WO | 2014144678 | A2 | 9/2014 |
| WO | 2015035557 | A1 | 3/2015 |
| WO | 2015042796 | A1 | 4/2015 |
| WO | 2015108816 | A2 | 7/2015 |
| WO | 2015179292 | A1 | 11/2015 |
| WO | 2016079152 | A1 | 5/2016 |
| WO | 2016096497 | A1 | 6/2016 |
| WO | 2016122417 | A1 | 8/2016 |
| WO | 2016156609 | A1 | 10/2016 |
| WO | 2017001820 | A1 | 1/2017 |
| WO | 2017005471 | A1 | 1/2017 |
| WO | 2017068098 | A1 | 4/2017 |
| WO | 2017077503 | A1 | 5/2017 |
| WO | 2017118557 | A1 | 7/2017 |
| WO | 2017162691 | A1 | 9/2017 |
| WO | 2017163045 | A1 | 9/2017 |
| WO | 2017163046 | A1 | 9/2017 |
| WO | 2017167513 | A1 | 10/2017 |
| WO | 2018050030 | A1 | 3/2018 |
| WO | 2018055334 | A1 | 3/2018 |
| WO | 2018130023 | A1 | 7/2018 |
| WO | 2018157638 | A1 | 9/2018 |
| WO | 2018172765 | A1 | 9/2018 |
| WO | 2018178962 | A2 | 10/2018 |
| WO | 2019050132 | A1 | 3/2019 |
| WO | 2019084161 | A1 | 5/2019 |
| WO | 2020157635 | A2 | 8/2020 |

OTHER PUBLICATIONS

"Decision to Grant received for Russian Patent Application No. 2023127122, mailed on Mar. 6, 2024", 20 pages (10 pages of English Translation and 10 pages of Original Copy).

"Extended European Search Report for Application No. 21197564.4, mailed on Sep. 23, 2022", 14 pages.

"Extended European Search Report received for European Application No. 21213237.7, mailed on Feb. 9, 2022", 9 pages.

"International Preliminary Report on Patentability received for PCT Patent Application No. PCT/GB2020/050376, mailed on Aug. 26, 2021", 12 pages.

"International Search Report and Written Opinion received for PCT Patent Application No. PCT/GB2020/050376, mailed on Jul. 7, 2020", 16 pages.

"Invitation to Pay Additional Fees received for PCT Patent Application No. PCT/GB2020/050376, mailed on May 15, 2020", 10 pages.

"Notice of Reasons for Refusal received for Japanese Patent Application No. 2021-547871, mailed on Mar. 7, 2023", 12 pages (6 pages of English Translation and 6 pages of Official Copy Only).

"Office action and Search report for Russian Application No. 2021124316, mailed on Feb. 22, 2022", 10 pages.

"Office Action received for Australian Patent Application No. 2020225438, mailed on Aug. 11, 2022", 4 pages.

"Search Report for Great Britain Application No. 1913946.8, mailed on Feb. 7, 2020", 4 pages.

Great Britain Search Report , "Great Britain Application No. GB1902220.1, mailing date: Jul. 15, 2019", 3 pages.

"Notice of Reasons for Refusal received for Japanese Patent Application No. 2021-547871, mailed on Mar. 5, 2024", 18 pages (9 pages of English Translation and 9 pages of Official Copy).

"Reasons for Refusal received for Japanese Patent Application No. 2023-059941, mailed on Jun. 4, 2024", 12 pages (6 Pages of English Translation and 6 pages of Official Copy).

(56) References Cited

OTHER PUBLICATIONS

"Decision to Grant received for Ukrainian Patent Application No. a202104682, mailed on Oct. 2, 2024", 8 pages (4 pages of English Translation and 4 page of Official Copy).
"Notice of Allowance received for Russian Patent Application No. 2022109745, mailed on Aug. 26, 2022", 16 pages (8 pages of English Translation and 8 pages of Official Copy).
"Office Action received for Canadian Patent Application No. 3, 130,602, mailed on Nov. 30, 2022", 7 pages.
"Office Action received for Canadian Patent Application No. 3, 190,708, mailed on Jun. 7, 2024", 6 pages.
"Office Action received for Mexican Patent Application No. MX/a/2021/009866, mailed on Aug. 5, 2024", 10 pages (5 pages of English Translation and 5 pages of Official Copy).
"Reasons for Refusal received for Japanese Patent Application No. 2021-547871, mailed on Jul. 4, 2023", 17 pages (8 Pages of English Translation and 9 pages of Official Copy).
"Search Report received for Great Britain Paten Application No. 1913941.9, mailed on Feb. 7, 2020", 13 pages.
"Notice of Opposition received for European Patent Application No. 21213237.7, mailed on Nov. 19, 2024", 47 pages.

* cited by examiner

AEROSOL PROVISION SYSTEM HAVING A RESERVOIR WITH A DIVIDING WALL ELEMENT

PRIORITY CLAIM

The present application is a Continuation of U.S. application Ser. No. 17/310,697, filed Aug. 18, 2021, which is a National Phase entry of PCT Application No. PCT/GB2020/050376, filed Feb. 18, 2020, which claims priority from Great Britain Application No. 1902220.1, filed Feb. 18, 2019, each of which is hereby fully incorporated herein by reference.

TECHNICAL FIELD

The present disclosure relates to aerosol provision systems such as, but not limited to, nicotine delivery systems (e.g. electronic cigarettes and the like).

BACKGROUND

Electronic aerosol provision systems such as electronic cigarettes (e-cigarettes) generally contain an aerosol precursor material, such as a reservoir of a source liquid containing a formulation, typically but not necessarily including nicotine, or a solid material such a tobacco-based product, from which an aerosol is generated for inhalation by a user, for example through heat vaporization. Thus, an aerosol provision system will typically comprise a heating element, e.g. a heating element, arranged to vaporize a portion of precursor material to generate an aerosol in an aerosol generation region of an air channel through the aerosol provision system. As a user inhales on the device and electrical power is supplied to the heating element, air is drawn into the device through one or more inlet holes and along the air channel to the aerosol generation region, where the air mixes with the vaporized precursor material and forms a condensation aerosol. The air drawn through the aerosol generation region continues along the air channel to a mouthpiece opening, carrying some of the aerosol with it, and out through the mouthpiece opening for inhalation by the user.

It is common for aerosol provision systems to comprise a modular assembly, often having two main functional parts, namely a control unit and disposable/replaceable cartridge part. Typically the cartridge part will comprise the consumable aerosol precursor material and the heating element (atomizer), while the control unit part will comprise longer-life items, such as a rechargeable battery, device control circuitry, activation sensors and user interface features. The control unit may also be referred to as a reusable part or battery section and the replaceable cartridge may also be referred to as a disposable part or cartomizer.

The control unit and cartridge are mechanically coupled together at an interface for use, for example using a screw thread, bayonet, latched or friction fit fixing. When the aerosol precursor material in a cartridge has been exhausted, or the user wishes to switch to a different cartridge having a different aerosol precursor material, the cartridge may be removed from the control unit and a replacement cartridge may be attached to the device in its place.

A potential drawbacks for cartridges containing liquid aerosol precursor (e-liquid) is the risk of leakage. An e-cigarette cartridge will typically have a mechanism, e.g. a capillary wick, for drawing liquid from a liquid reservoir to a heating element located in an air path/channel connecting from an air inlet to an aerosol outlet for the cartridge.

Because there is a fluid transport path from the liquid reservoir into the open air channel through the cartridge, there is a corresponding risk of liquid leaking from the cartridge. Leakage is undesirable both from the perspective of the end user naturally not wanting to get the e-liquid on their hands or other items, and also from a reliability perspective, since leakage from an end of the cartridge connected to the control unit may damage the control unit, for example due to corrosion. Some approaches to reduce the risk of leakage may involve restricting the flow of liquid to the heating element, for example by tightly clamping a wick where it enters the air channel, but this can in some scenarios lead to a risk of insufficient liquid being supplied to the heating element (dry-out), which can give rise to overheating and undesirable flavors.

Various approaches are described herein which seek to help address or mitigate some of the issues discussed above.

SUMMARY

According to a first aspect of certain embodiments there is provided a cartridge for an aerosol provision system comprising the cartridge and a control unit, wherein the cartridge comprises:

- an air channel extending from an air inlet for the cartridge to an aerosol outlet via a aerosol generation region;
- a heating element for heating liquid from a reservoir to generate aerosol in the aerosol generation region;
- a valve located in the air channel upstream of the aerosol generating region;
- wherein the cartridge is configured such that air passing through the air channel is configured to pass from the air inlet, past the air valve, into the aerosol generating region, and then out from the aerosol outlet.

According to a second aspect of certain embodiments there is provided an aerosol provision system comprising the cartridge from the first aspect and a control unit, wherein the control unit comprises a cartridge receiving section that includes an interface arranged to cooperatively engage with the cartridge so as to releasably couple the cartridge to the control unit, wherein the control unit further comprises a power supply and control circuitry configured to selective supply power from the power supply to the heating element in the cartridge via their cooperatively engaging interfaces.

According to a third aspect of certain embodiments there is provided a method of generating aerosol from a cartridge for an aerosol provision system, wherein the cartridge comprises:

- an aerosol outlet;
- an air channel extending from an air inlet for the cartridge to the aerosol outlet via a aerosol generation region; and
- a heating element for heating liquid from a reservoir to generate aerosol in the aerosol generation region;
- a valve located in the air channel upstream of the aerosol generating region;
- wherein the method comprises passing air through the air channel from the air inlet, past the air valve, into the aerosol generating region, and then out from the aerosol outlet.

It will be appreciated that features and aspects of the invention described above in relation to the various aspects of the invention are equally applicable to, and may be combined with, embodiments of the invention according to other aspects of the invention as appropriate, and not just in the specific combinations described herein.

BRIEF DESCRIPTION OF THE DRAWINGS

Embodiments of the invention will now be described, by way of example only, with reference to the accompanying drawings, in which.

DETAILED DESCRIPTION OF THE DRAWINGS

Figure 1:
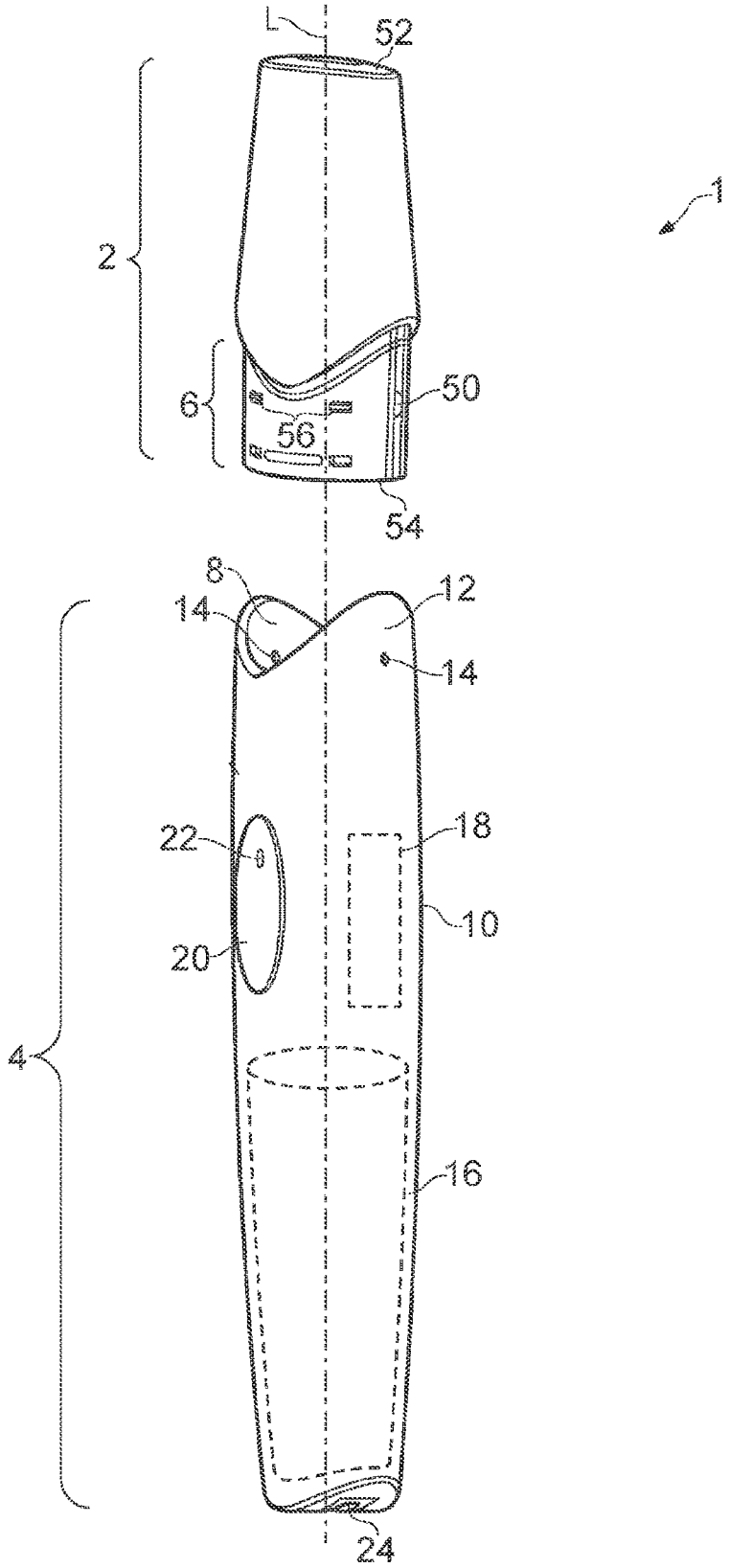
FIG. 1 schematically represents in perspective view an aerosol provision system comprising a cartridge and control unit (shown separated) in accordance with certain embodiments of the disclosure.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to non-combustible aerosol provision systems, which may also be referred to as aerosol provision systems, such as e-cigarettes. According to the present disclosure, a "non-combustible" aerosol provision system is one where a constituent aerosolizable material of the aerosol provision system (or component thereof) is not combusted or burned in order to facilitate delivery to a user. Aerosolizable material, which also may be referred to herein as aerosol generating material or aerosol precursor material, is material that is capable of generating aerosol, for example when heated, irradiated or energized in any other way.

Throughout the following description the term "e-cigarette" or "electronic cigarette" may sometimes be used, but it will be appreciated this term may be used interchangeably with aerosol provision system/device and electronic aerosol provision system/device. An electronic cigarette may also known as a vaping device or electronic nicotine delivery system (END), although it is noted that the presence of nicotine in the aerosolizable material is not a requirement.

In some embodiments, the non-combustible aerosol provision system is a hybrid system to generate aerosol using a combination of aerosolizable materials, one or a plurality of which may be heated. In some embodiments, the hybrid system comprises a liquid or gel aerosolizable material and a solid aerosolizable material. The solid aerosolizable material may comprise, for example, tobacco or a non-tobacco product.

Typically, the non-combustible aerosol provision system may comprise a non-combustible aerosol provision device and an article for use with the non-combustible aerosol provision device. However, it is envisaged that articles which themselves comprise a means for powering an aerosol generating component may themselves form the non-combustible aerosol provision system.

In some embodiments, the article for use with the non-combustible aerosol provision device may comprise an aerosolizable material (or aerosol precursor material), an aerosol generating component (or vaporizer), an aerosol generating area, a mouthpiece, and/or an area for receiving aerosolizable material.

In some embodiments, the aerosol generating component is a heater capable of interacting with the aerosolizable material so as to release one or more volatiles from the aerosolizable material to form an aerosol. In some embodiments, the aerosol generating component is capable of generating an aerosol from the aerosolizable material without heating. For example, the aerosol generating component may be capable of generating an aerosol from the aerosolizable material without applying heat thereto, for example via one or more of vibrational, mechanical, pressurization or electrostatic means.

In some embodiments, the substance to be delivered may be an aerosolizable material which may comprise an active constituent, a carrier constituent and optionally one or more other functional constituents.

The active constituent may comprise one or more physiologically and/or olfactory active constituents which are included in the aerosolizable material in order to achieve a physiological and/or olfactory response in the user. The active constituent may for example be selected from nutraceuticals, nootropics, and psychoactives. The active constituent may be naturally occurring or synthetically obtained. The active constituent may comprise for example nicotine, caffeine, taurine, theine, a vitamin such as B6 or B12 or C, melatonin, a cannabinoid, or a constituent, derivative, or combinations thereof. The active constituent may comprise a constituent, derivative or extract of tobacco or of another botanical. In some embodiments, the active constituent is a physiologically active constituent and may be selected from nicotine, nicotine salts (e.g. nicotine 9amien9ate/nicotine bitartrate), nicotine-free tobacco substitutes, other alkaloids such as caffeine, or mixtures thereof.

In some embodiments, the active constituent is an olfactory active constituent and may be selected from a "flavor" and/or "flavorant" which, where local regulations permit, may be used to create a desired taste, aroma or other somatosensorial sensation in a product for adult consumers. In some instances such constituents may be referred to as flavors, flavorants, cooling agents, heating agents, and/or sweetening agents. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, 10amien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gasone or more of extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

The carrier constituent may comprise one or more constituents capable of forming an aerosol. In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional constituents may comprise one or more of pH regulators, coloring agents, preservatives, binders, fillers, stabilizers, and/or antioxidants.

As noted above, aerosol provision systems (e-cigarettes) often comprise a modular assembly including both a reusable part (control unit) and a replaceable (disposable) cartridge part. Devices conforming to this type of two-part modular configuration may generally be referred to as two-part devices. It is also common for electronic cigarettes to have a generally elongate shape. For the sake of providing a concrete example, certain embodiments of the disclosure described herein comprise this kind of generally elongate two-part device employing disposable cartridges. However, it will be appreciated the underlying principles described herein may equally be adopted for other electronic cigarette configurations, for example modular devices comprising more than two parts, as devices conforming to other overall shapes, for example based on so-called box-mod high performance devices that typically have a more boxy shape.

FIG. 1 is a schematic perspective view of an example aerosol provision system/device (e-cigarette) 1 in accordance with certain embodiments of the disclosure. Terms concerning the relative location of various aspects of the electronic cigarette (e.g. terms such as upper, lower, above, below, top, bottom etc.) are used herein with reference to the orientation of the electronic cigarette as shown in FIG. 1 (unless the context indicates otherwise). However, it will be appreciated this is purely for ease of explanation and is not intended to indicate there is any required orientation for the electronic cigarette in use.

The e-cigarette 1 comprises two main components, namely a cartridge 2 and a control unit 4. The control unit 4 and the cartridge 2 are shown separated in FIG. 1, but are coupled together when in use.

The cartridge 2 and control unit 4 are coupled by establishing a mechanical and electrical connection between them. The specific manner in which the mechanical and electrical connection is established is not of primary significance to the principles described herein and may be established in accordance with conventional techniques, for example based around a screw thread, bayonet, latched or friction-fit mechanical fixing with appropriately arranged electrical contacts/electrodes for establishing the electrical connection between the two parts as appropriate. For example electronic cigarette 1 represented in FIG. 1, the cartridge comprises a mouthpiece end 52 and an interface end 54 and is coupled to the control unit by inserting an interface end portion 6 at the interface end of the cartridge into a corresponding receptacle 8/receiving section of the control unit. The interface end portion 6 of the cartridge is a close fit to be receptacle 8 and includes protrusions 56 which engage with corresponding detents in the interior surface of a receptacle wall 12 defining the receptacle 8 to provide a releasable mechanical engagement between the cartridge and the control unit. An electrical connection is established between the control unit and the cartridge via a pair of electrical contacts on the bottom of the cartridge (not shown in FIG. 1) and corresponding sprung contact pins in the base of the receptacle 8 (not shown in FIG. 1). As noted above, the specific manner in which the electrical connection is established is not significant to the principles described herein, and indeed some implementations might not have an electrical connection between the cartridge and a control unit at all, for example because the transfer of electrical power from the reusable part to the cartridge may be wireless (e.g. based on electromagnetic induction techniques).

The electronic cigarette 1 has a generally elongate shape extending along a longitudinal axis L. When the cartridge is coupled to the control unit, the overall length of the electronic cigarette in this example (along the longitudinal axis) is around 12.5 cm. The overall length of the control unit is around 9 cm and the overall length of the cartridge is around 5 cm (i.e. there is around 1.5 cm of overlap between the interface end portion 6 of the cartridge and the receptacle 8 of the control unit when they are coupled together). The electronic cigarette has a cross-section which is generally oval and which is largest around the middle of the electronic cigarette and tapers in a curved manner towards the ends. The cross-section around the middle of the electronic cigarette has a width of around 2.5 cm and a thickness of around 1.7 cm. The end of the cartridge has a width of around 2 cm and a thickness of around 0.6 mm, whereas the other end of the electronic cigarette has a width of around 2 cm and a thickness of around 1.2 cm. The outer housing of the electronic cigarette is in this example is formed from plastic. It will be appreciated the specific size and shape of the electronic cigarette and the material from which it is made is not of primary significance to the principles described herein and may be different in different implementations. That is to say, the principles described herein may equally be adopted for electronic cigarettes having different sizes, shapes and/or materials.

The control unit 4 may in accordance with certain embodiments of the disclosure be broadly conventional in terms of its functionality and general construction techniques. In the example of FIG. 1, the control unit 4 comprises a plastic outer housing 10 including the receptacle wall 12 that defines the receptacle 8 for receiving the end of the cartridge as noted above. The outer housing 10 of the control unit 4 in this example has a generally oval cross section conforming to the shape and size of the cartridge 2 at their interface to provide a smooth transition between the two parts. The receptacle 8 and the interface end portion 6 of the cartridge 2 are symmetric when rotated through 180° so the cartridge can be inserted into the control unit in two different orientations. The receptacle wall 12 includes two control unit air inlet openings 14 (i.e. holes in the wall). These openings 14 are positioned to align with an air inlet 50 for the cartridge when the cartridge is coupled to the control unit. A different one of the openings 14 aligns with the air inlet 50 of the cartridge in the different orientations. It will be appreciated some implementations may not have any degree of rotational symmetry such that the cartridge is couplable to the control unit in only one orientation while other implementations may have a higher degree of rotational symmetry such that the cartridge is couplable to the control unit in more orientations.

The control unit further comprises a battery 16 for providing operating power for the electronic cigarette, control circuitry 18 for controlling and monitoring the operation of the electronic cigarette, a user input button 20, an indicator light 22, and a charging port 24.

The battery 16 in this example is rechargeable and may be of a conventional type, for example of the kind normally used in electronic cigarettes and other applications requiring provision of relatively high currents over relatively short periods. The battery 16 may be recharged through the charging port 24, which may, for example, comprise a Universal Serial Bus (USB) connector.

The input button 20 in this example is a conventional mechanical button, for example comprising a sprung mounted component which may be pressed by a user to establish an electrical contact in underlying circuitry. In this regard, the input button may be considered an input device for detecting user input, e.g. to trigger aerosol generation, and the specific manner in which the button is implemented is not significant. For example, other forms of mechanical button or touch-sensitive button (e.g. based on capacitive or optical sensing techniques) may be used in other implementations, or there may be no button and the device may rely on a puff detector for triggering aerosol generation.

The indicator light 22 is provided to give a user with a visual indication of various characteristics associated with the electronic cigarette, for example, an indication of an operating state (e.g. on/off/standby), and other characteristics, such as battery life or fault conditions. Different characteristics may, for example, be indicated through different colors and/or different flash sequences in accordance with generally conventional techniques.

The control circuitry 18 is suitably configured/programmed to control the operation of the electronic cigarette to provide conventional operating functions in line with the established techniques for controlling electronic cigarettes. The control circuitry (processor circuitry) 18 may be considered to logically comprise various sub-units/circuitry elements associated with different aspects of the electronic cigarette's operation. For example, depending on the functionality provided in different implementations, the control circuitry 18 may comprises power supply control circuitry for controlling the supply of power from the battery to the cartridge in response to user input, user programming circuitry for establishing configuration settings (e.g. user-defined power settings) in response to user input, as well as other functional units/circuitry associated functionality in accordance with the principles described herein and conventional operating aspects of electronic cigarettes, such as indicator light display driving circuitry and user input detection circuitry. It will be appreciated the functionality of the control circuitry 18 can be provided in various different ways, for example using one or more suitably programmed programmable computer(s) and/or one or more suitably configured application-specific integrated circuit(s)/circuitry/chip(s)/chipset(s) configured to provide the desired functionality.

Figure 2:
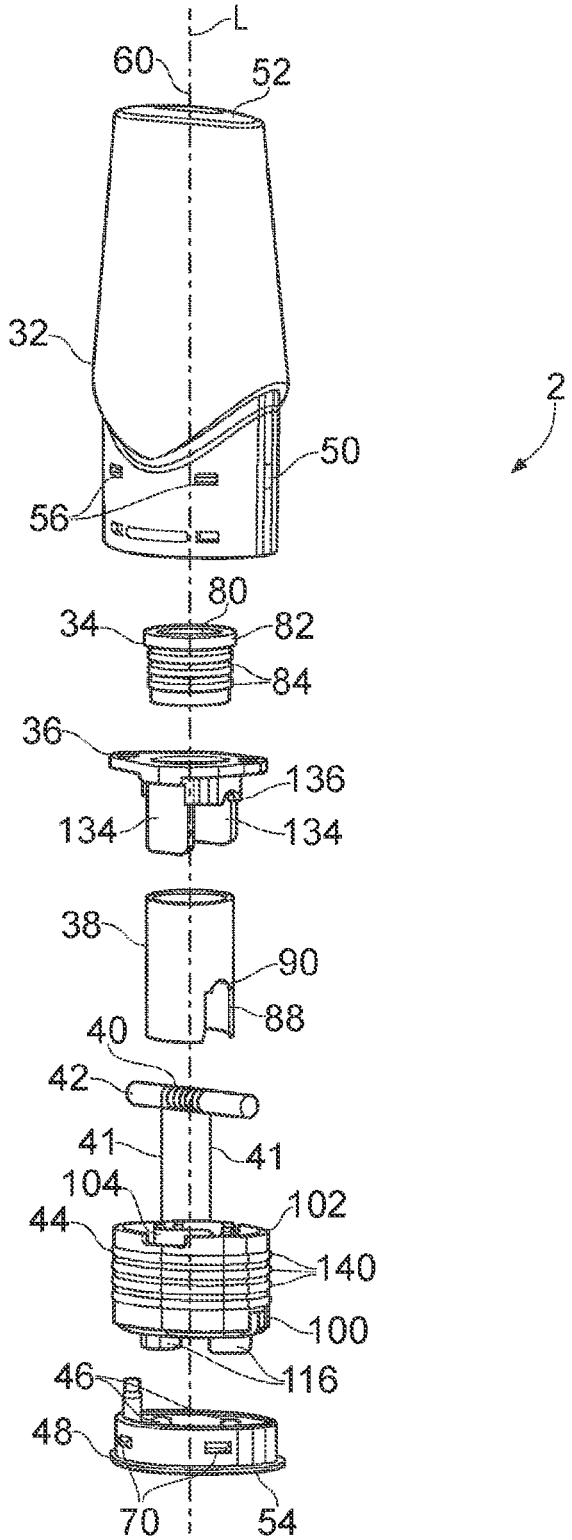
FIG. 2 schematically represents in exploded perspective view of components of the cartridge of the aerosol provision system of FIG. 1.

FIG. 2 is an exploded schematic perspective view of the cartridge 2 (exploded along the longitudinal axis L). The cartridge 2 comprises a housing part 32, an air channel seal 34, a dividing wall element 36, an outlet tube 38, a heating element 40, a liquid transport element 42, a plug 44, and an end cap 48 with contact electrodes 46. FIGS. 3 to 6 schematically represents some of these components in more detail.

Figure 3A:
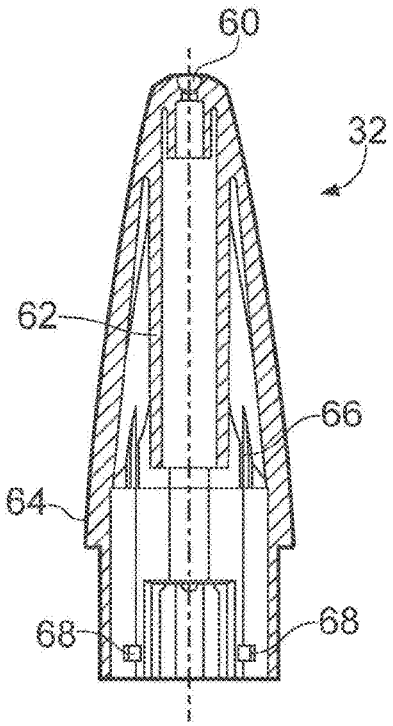
FIGS. 3A to 3C schematically represent various cross-section views of a housing part of the cartridge of the aerosol provision system of FIG. 1.
Figure 3B:
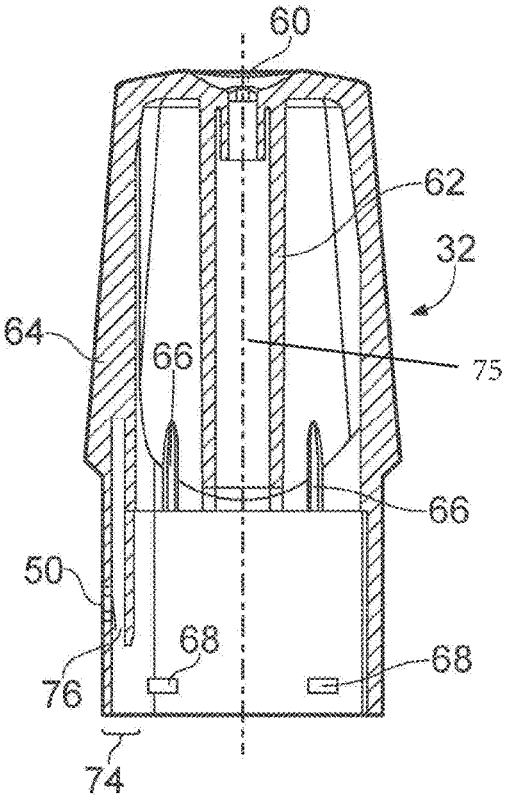
Figure 3C:
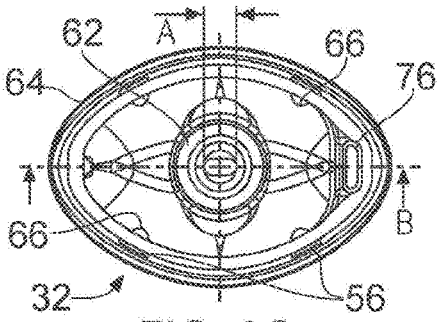

FIG. 3A is a schematic cut-away view of the housing part 32 through the longitudinal axis L where the housing part 32 is thinnest. FIG. 3B is a schematic cut-away view of the housing part 32 through the longitudinal axis L where the housing part 32 is widest. FIG. 3C is a schematic view of the housing part along the longitudinal axis L from the interface end 54 (i.e. viewed from below in the orientation of FIGS. 3A and 3B).

Figure 4A:
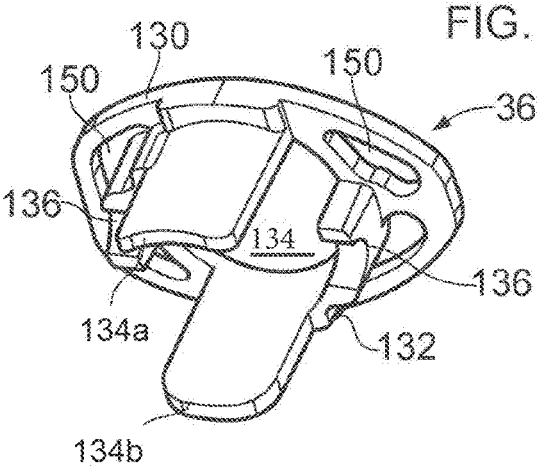
FIGS. 4A and 4B schematically represent a perspective view and a plan view of a dividing wall element of the cartridge of the aerosol provision system of FIG. 1.
Figure 4B:
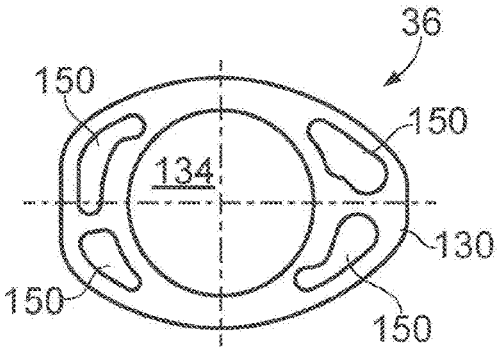

FIG. 4A is a schematic perspective view of the dividing wall element 36 as seen from below. FIG. 4B is a schematic cross-section through an upper part of the dividing wall element 36 as viewed from below.

Figure 5A:
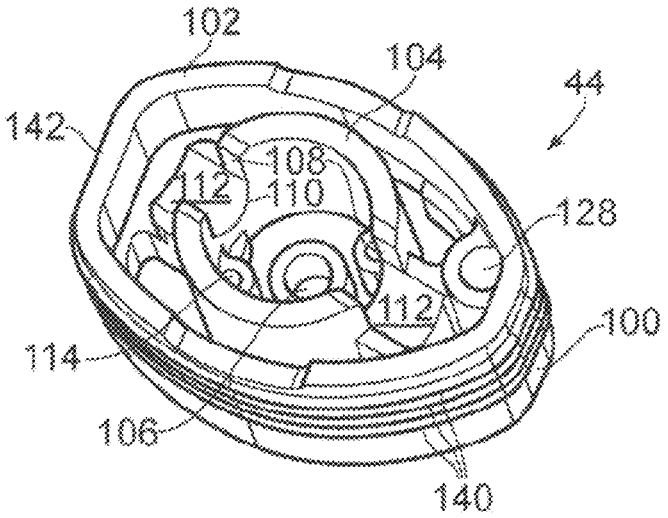
FIGS. 5A to 5C schematically represent two perspective views and a plan view of a resilient plug of the cartridge of the aerosol provision system of FIG. 1.
Figure 5B:
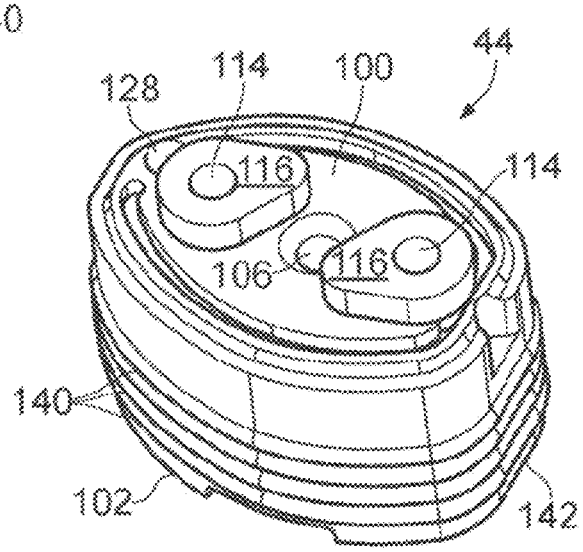
Figure 5C:
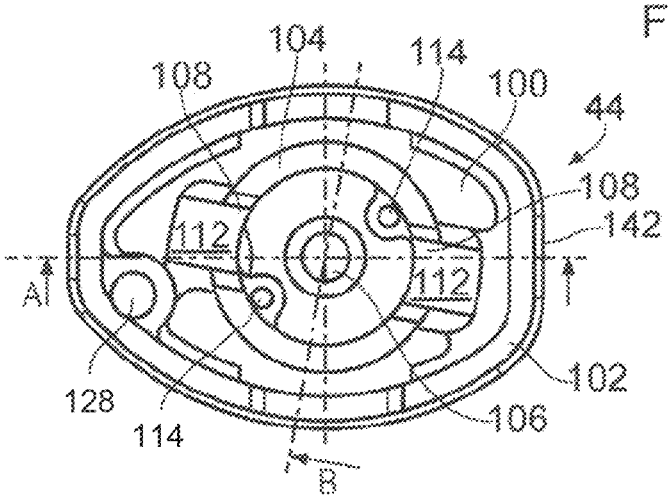

FIG. 5A is a schematic perspective view of the plug 44 from above and FIG. 5B is a schematic perspective view of the plug 44 from below. FIG. 5C is a schematic view of the plug 44 along the longitudinal axis L seen from the mouthpiece end 52 of the cartridge (i.e. viewed from above for the orientation in FIGS. 1 and 2).

Figure 6A:
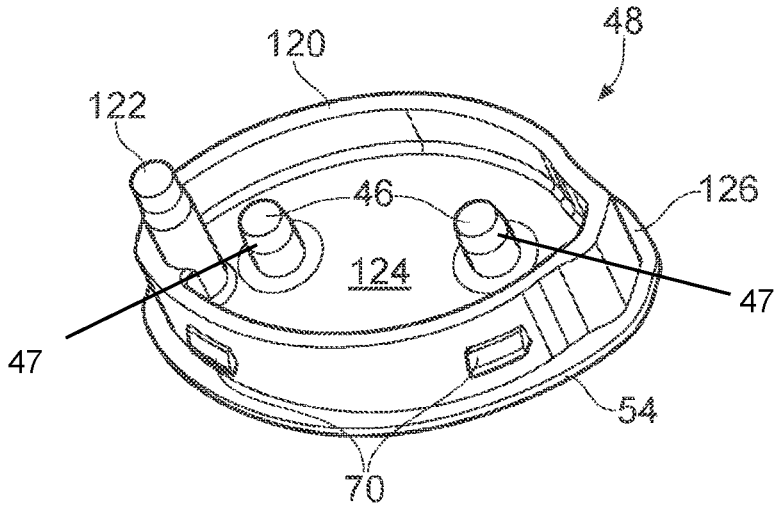
FIGS. 6A and 6B schematically represent a perspective view and a plan view of a bottom cap of the cartridge of the aerosol provision system of FIG. 1.
Figure 6B:
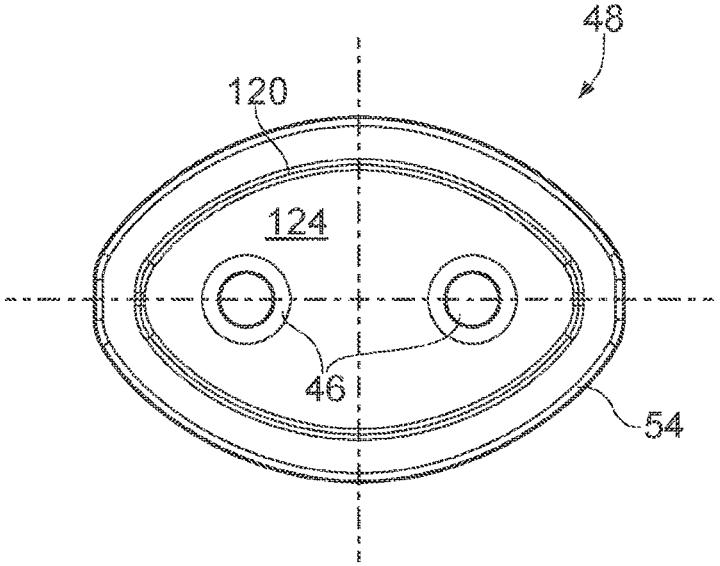

FIG. 6A is a schematic perspective view of the end cap 48 from above. FIG. 6B is a schematic view of the end cap 48 along the longitudinal axis L seen from the mouthpiece end 52 of the cartridge (i.e. from above).

The housing part 32 in this example comprises a housing outer wall 64 and a housing inner tube 62 which in this example are formed from a single molding of polypropylene. The housing outer wall 64 defines the external appearance of the cartridge 2 and the housing inner tube 62 defines a part the air channel through the cartridge. The housing part is open at the interface end 54 of the cartridge and closed at the mouthpiece end 52 of the cartridge except for a mouthpiece opening/aerosol outlet 60 in fluid communication with the housing inner tube 62. The housing part 32 includes an opening in a sidewall which provides the air inlet 50 for the cartridge. The air inlet 50 in this example has an area of around 2 $mm^2$. The outer surface of the outer wall 64 of the housing part 32 includes the protrusions 56 discussed above which engage with corresponding detents in the interior surface of the receptacle wall 12 defining the receptacle 8 to provide a releasable mechanical engagement between the cartridge and the control unit. The inner surface of the outer wall 64 of the housing part includes further protrusions 66 which act to provide an abutment stop for locating the dividing wall element 36 along the longitudinal axis L when the cartridge is assembled. The outer wall 64 of the housing part 32 further comprises holes which provide latch recesses 68 arranged to receive corresponding latch projections 70 in the end cap 48 to fix the end cap 48 to be housing part when the cartridge is assembled.

The outer wall 64 of the housing part 32 includes a double-walled section 74 that defines a gap 76 of air channel 75 in fluid communication with the air inlet 50. The gap 76 provides a portion of the air channel through the cartridge. In this example the doubled-walled section 74 of the housing part 32 is arranged so the gap defines an air channel 75 running within the housing outer wall 64 parallel to the longitudinal axis with a cross-section in a plane perpendicular to the longitudinal axis of around 3 $mm^2$. The gap 76 defined by the double-walled section of the housing part extends down to the open end of the housing part 32.

The air channel seal 34 is a silicone molding generally in the form of a tube having a through hole 80. The outer wall of the air channel seal 34 includes circumferential ridges 84 and an upper collar 82. The inner wall of the air channel seal 34 also includes circumferential ridges, but these are not visible in FIG. 2. When the cartridge is assembled the air channel seal 34 is mounted to the housing inner tube 62 with an end of the housing inner tube 62 extending partly into the through hole 80 of the air channel seal 34. The through hole 80 in the air channel seal has a diameter of around 5.8 mm in its relaxed state whereas the end of the housing inner tube 62 has a diameter of around 6.2 mm so that a seal is formed when the air channel seal 34 is stretched to accommodate the housing inner tube 62. This seal is facilitated by the ridges on the inner surface of the air channel seal 34.

The outlet tube 38 comprises a tubular section of American National Standards Institute (ANSI) 304 stainless steel with an internal diameter of around 8.6 mm and a wall thickness of around 0.2 mm. The bottom end of the outlet tube 38 includes a pair of diametrically opposing slots 88 with an end of each slot having a semi-circular recess 90. When the cartridge is assembled the outlet tube 38 mounts to the outer surface of the air channel seal 34. The outer diameter of the air channel seal is around 9.0 mm in its relaxed state so that a seal is formed when the air channel seal 34 is compressed to fit inside the outlet tube 38. This seal is facilitated by the ridges 84 on the outer surface of the air channel seal 34. The upper collar 82 on the air channel seal 34 provides a stop for the outlet tube 38.

The liquid transport element 42 comprises a capillary wick and the heating element 40 comprises a resistance wire heater wound around the capillary wick. In addition to the portion of the resistance wire wound around the capillary wick, the heating element comprises electrical leads 41 which pass through holes in the plug 44 to contact electrodes 46 mounted to the end cap 48 to allow power to be supplied to the heating element via the electrical interface the established when the cartridge is connected to a control unit. The electrical leads 41 may comprise the same material as the resistance wire wound around the capillary wick, or may comprise a different material (e.g. lower-resistance material) connected to the resistance wire wound around the capillary wick. In this example the heater element 40 comprises a coil formed from a nickel iron alloy wire and the wick 42 comprises a glass fiber bundle. The heating element and liquid transport element may be provided in accordance with any conventional techniques and is may comprise different forms and/or different materials. For example, in some implementations the wick may comprise fibrous or solid a ceramic material and the heater may comprise a different alloy. In other examples the heater and wick may be combined, for example in the form of a porous and a resistive material. More generally, it will be appreciated the specific nature liquid transport element and heating element is not of primary significance to the principles described herein.

When the cartridge is assembled, the wick 42 is received in the semi-circular recesses 90 of the outlet tube 38 so that a central portion of the wick about which the heating coil is would is inside the outlet tube while end portions of the wick are outside the outlet tube 38.

The plug 44 in this example comprises a single molding of silicone, may be resilient. The plug comprises a base part 100 with an outer wall 102 extending upwardly therefrom (i.e. towards the mouthpiece end of the cartridge). The plug further comprises an inner wall 104 extending upwardly from the base part 100 and surrounding a through hole 106 through the base part 100.

The outer wall 102 of the plug 44 conforms to an inner surface of the housing part 32 so that when the cartridge is assembled the plug in 44 forms a seal with a the housing part 32. The inner wall 104 of the plug 44 conforms to an inner surface of the outlet tube 38 so that when the cartridge is assembled the plug 44 also forms a seal with the outlet tube 38. The inner wall 104 includes a pair of diametrically opposing slots 108 with the end of each slot having a semi-circular recess 110. Extended outwardly (i.e. in a direction away from the longitudinal axis of the cartridge) from the bottom of each slot in the inner wall 104 is a cradle section 112 shaped to receive a section of the liquid transport element 42 when the cartridge is assembled. The slots 108 and semi-circular recesses 110 provided by the inner wall of the plug 44 and the slots 88 and semi-circular recesses 90 of the outlet tube 38 are aligned so that the slots 88 in the outlet tube 38 accommodate respective ones of the cradles 112 with the respective semi-circular recesses in the outlet tube and plug cooperating to define holes through which the liquid transport element passes. The size of the holes provided by the semi-circular recesses through which the liquid transport element passes correspond closely to the size and shape of the liquid transport element, but are slightly smaller so a degree of compression is provided by the resilience of the plug 44. This allows liquid to be transported along the liquid transport element by capillary action while restricting the extent to which liquid which is not transported by capillary action can pass through the openings. As noted above, the plug 44 includes further openings 114 in the base part 100 through which the electrical leads 41 for the heating element pass when the cartridge is assembled. The bottom of the base part of the plug includes spacers 116 which maintain an offset between the remaining surface of the bottom of the base part and the end cap 48. These spacers 116 include the openings 114 through which the electrical leads 41 for the heating element pass.

The end cap 48 comprises a polypropylene molding with a pair of gold-plated copper electrode posts 46 mounted therein.

The ends of the electrode posts 46 on the bottom side of the end cap 48 are close to flush with the interface end 54 of the cartridge provided by the end cap 48. These are the parts of the electrodes to which correspondingly aligned sprung contacts in the control unit connect when the cartridge is assembled and connected to the control unit. The ends of the electrode posts on the inside of the cartridge extend away from the end cap 48 and into the holes 114 in the plug 44 through which the electrical leads 41 pass. The electrode posts are slightly oversized relative to the holes 114 and include a chamfer 47 at their upper ends to facilitate insertion into the holes 114 in the plug where they are maintained in pressed contact with the contact leads for the heating element by virtue of the plug.

The end cap has a base section 124 and an upstanding wall 120 which conforms to the inner surface of the housing part 32. The upstanding wall 120 of the end cap 48 is inserted into the housing part 32 so the latch projections 70 engage with the latch recesses 68 in the housing part 32 to snap-fit the end cap 48 to the housing part when the cartridge is assembled. The top of the upstanding wall 120 of the end cap 48 abuts a peripheral part of the plug 44 and the lower face of the spacers 116 on the plug also abut the base section 124 of the end cap 48 so that when the end cap 48 is attached to the housing part it presses against the plug 44 to maintain it in slight compression.

The base portion 124 of the end cap 48 includes a peripheral lip 126 beyond the base of the upstanding wall 112 with a thickness which corresponds with the thickness of the outer wall of the housing part at the interface end of the cartridge. The end cap also includes an upstanding locating pin 122 which aligns with a corresponding locating hole 128 in the plug to help establish their relative location during assembly.

The dividing wall element 36 comprises a single molding of polypropylene and includes a dividing wall 130 and a collar 132 formed by projections from the dividing wall 130 in the direction towards the interface end of the cartridge. The dividing wall element 36 has a central opening 134 through which the outlet tube 38 passes (i.e. the dividing wall is arranged around the outlet tube 38). When the cartridge is assembled, the upper surface of the outer wall 102 of the plug 44 engages with the lower surface of the dividing wall 130, and the upper surface of the dividing wall 130 in turn engages with the projections 66 on the inner surface of the outer wall 64 of the housing part 32. Thus, the dividing wall 130 prevents the plug from being pushed too far into the housing part 32—i.e. the dividing wall 130 is fixedly located along the longitudinal axis of the cartridge by the protrusions 66 in the housing part and so provides the plug with a fixed surface to push against. The collar 132 formed by projections from the dividing wall includes a first pair of opposing projections/tongues 134*a*, 134*b* which engage with corresponding recesses on an inner surface of the outer wall 102 of the plug 44. The projections from the dividing wall 130 further provide a pair of cradle sections 136 configured to engage with corresponding ones of the cradle sections 112 in the plug 44 when the cartridge is assembled to further define the opening through which the liquid transport element passes.

When the cartridge is assembled an air channel 75 extending from the air inlet 50 to the aerosol outlet 60 through the cartridge is formed. Starting from the air inlet 50 in the side wall of the housing part 32, a first portion of the air channel 75 is provided by the gap 76 formed by the double-walled section 74 in the outer wall 64 of the housing part 32 and extends from the air inlet 50 towards the interface end 54 of the cartridge and past the plug 44. A second portion of the air channel 75 is provided by the gap between the base part 100 of the plug 44 and the end cap 48. A third portion of the air channel 75 is provided by the hole 106 through the plug 44. A fourth portion of the air channel 75 is provided by the region within the inner wall 104 of the plug and the outlet tube around the heating element 40. This fourth portion of the air channel 75 may also be referred to as an aerosol/aerosol generation region, it being the primary region in which aerosol is generated during use. The air channel from the air inlet 50 to the aerosol generation region may be referred to as an air inlet section of the air channel. A fifth portion of the air channel 75 is provided by the remainder of the outlet tube 38. A sixth portion of the air channel 75 is provided by the outer housing inner tube 62 which connects the air channel to the aerosol outlet 60. The air channel 75 from the aerosol generation region to be the aerosol outlet may be referred to as an aerosol outlet section of the air channel.

Figure 7:
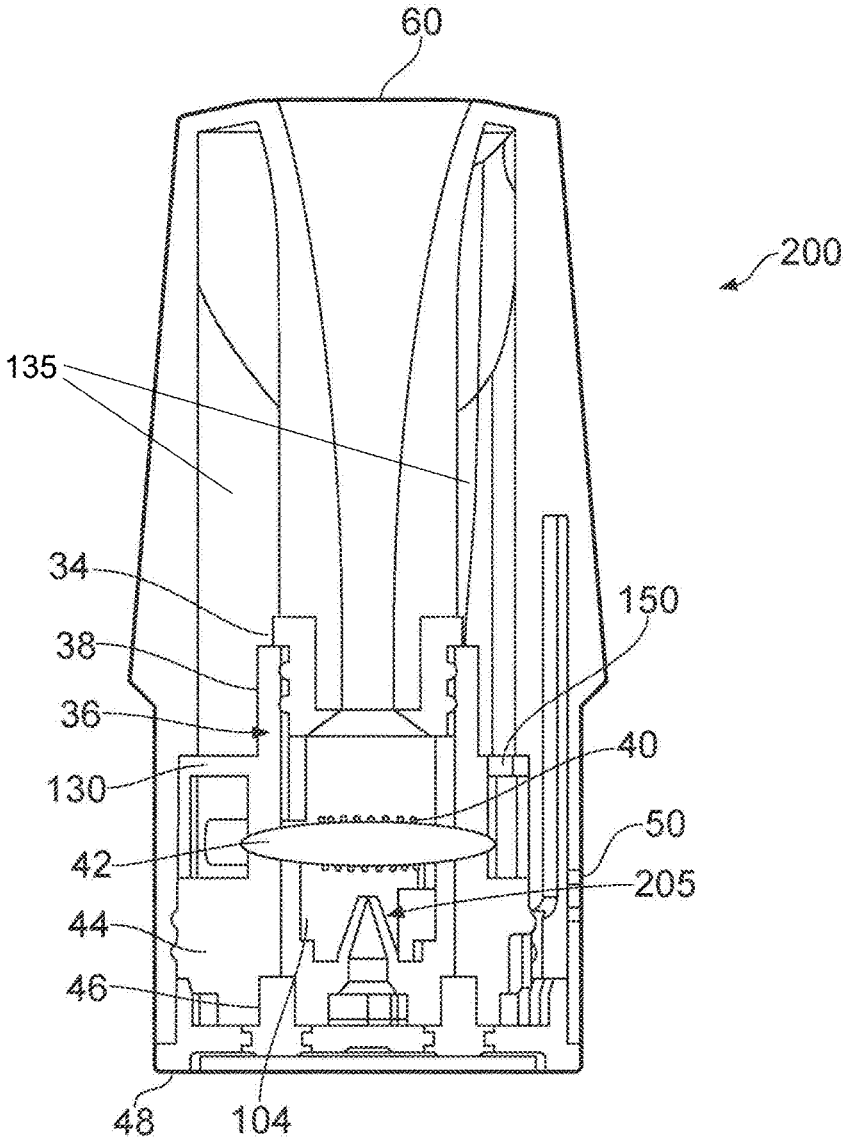
FIG. 7 schematically represents as a cross section view a modified cartridge for use with the control unit shown in FIG. 1 to form an aerosol provision system in accordance with certain embodiments of the disclosure.

Also, when the cartridge is assembled a reservoir 135 for liquid as shown in FIG. 7 is formed by the space outside the air channel 75 and inside the housing part 32. This may be filled during manufacture, for example through a filling hole which is then sealed, or by other means. The specific nature of the liquid, for example in terms of its composition, is not of primary significance to the principles described herein, and in general any conventional liquid of the type normally used in electronic cigarettes may be used. The reservoir 135 is closed at the interface end of the cartridge by the plug 44. The reservoir 135 includes a first region 135*a* above the dividing wall 130 and a second region 135*b* below the dividing wall 130 within the space formed between the air channel 75 and the outer wall of the plug. The liquid transport element (capillary wick) 42 passes through openings in the wall of the air channel 75 provided by the semi-circular recesses 110, 90 in the plug 44 and the outlet tube 38 and the cradle sections 112, 136 in the plug 44 and the dividing wall element 36 that engage with one another as discussed above. Thus, the ends of the liquid transport element extend into the second region 135*b* of the reservoir from which they draw liquid through the openings in the air channel 75 to the heating element 40 for subsequent vaporization.

In normal use, the cartridge 2 is coupled to the control unit 4 and the control unit activated to supply power to the cartridge via the contact electrodes 46 in the end cap 48. Power then passes through the electrical leads 41 to the heating element 40. The heating element is thus electrically heated and so vaporizes a portion of the liquid from the liquid transport element in the vicinity of the heating element. This generates aerosol in the aerosol generation region of the air channel 75. Liquid that is vaporized from the liquid transport element is replaced by more liquid drawn from the reservoir by capillary action. While the heating element is activated, a user inhales on the mouthpiece end 52 of the cartridge. This causes air to be drawn through whichever air inlet opening 14 of the control unit 4 aligns with the air inlet 50 of the cartridge (which will depend on the orientation in which the cartridge was inserted into the control unit receptacle 8). Air then enters the cartridge through the air inlet 50, passes along the gap 76 in the double-walled section 74 of the housing part 32, passes between the plug 44 and the end cap 48 before entering the aerosol generation region surrounding the heating element 40 through the hole 106 in the base part 100 of the plug 44. The incoming air mixes with aerosol generated from the heating element to form a condensation aerosol, which is then drawn along the outlet tube 38 and the inner tube 62 of the housing part 32 before exiting through the aerosol outlet 60 for user inhalation.

With reference to FIG. 7, there is shown schematically a cross section view of a modified cartridge 200 for use with the control unit 4 shown in FIG. 1 to form an aerosol provision system in accordance with certain embodiments of the disclosure. The cartridge 200 shown in FIG. 7 is based on the construction of the cartridge 2 shown in FIGS. 1-6B, and comprises similar components as set out by the reference numerals that are common to both sets of Figures.

With reference to the cartridge 200 shown in FIG. 7, a first modification over the cartridge 2 shown in FIGS. 1-6B is the introduction of a valve 205 located in the air channel upstream of the aerosol generation region (i.e. the region within the inner wall 104 of the plug 44 and the outlet tube 38 around the heating element 40). The function of the valve 205 is to allow air to pass into aerosol generation region upon a user inhalation at the/aerosol outlet 60, but inhibit aerosol generated inside the aerosol generating region from flowing through the air channel back towards the air inlet 50 and/or down into the second portion of the air channel provided by the gap between the base part 100 of the plug 44 and the end cap 48. Preferably the valve is any type of one-way valve of a suitable size and operating characteristic for the particular cartridge 200. In some embodiments, the valve may be a reed valve or a duckbill valve.

In accordance with some embodiments, the valve 205 may be integrally formed with the plug 44. In this way, as opposed to having the valve 205 formed as a separate component to the plug 44, the overall number of separate components in the cartridge 200 can be reduced. As shown in FIG. 7, in some cases the valve 205 may taper inwardly in a direction extending away from the interface end, and such that it tapers inwardly inside the aerosol generating region. In this way any aerosol condensing on the valve 205 itself may slide off the valve, which better ensures the valve remains fully operational. In some embodiments, to ensure the momentum of air is preserved as it passes through the cartridge 200, the valve 205 may be orientated inside the cartridge such that the air passing through the valve 205 extends in a direction which is substantially parallel to the direction of aerosol passing through the aerosol outlet 60.

A second modification in the cartridge 200 shown in FIG. 7 over the cartridge 2 shown in FIGS. 1-6B is integrally forming the outlet tube 38 with the dividing wall element 36, to provide a portion of the air channel between the aerosol generation region and the aerosol outlet 60. By integrally forming these two components together as one, this reduces the overall component count in the cartridge 200. In some embodiments of this modified cartridge 200, the dividing wall element (which includes the dividing wall 130) along with the outlet tube 38 may be made of a plastic material, such as polypropylene.

Figure 8:
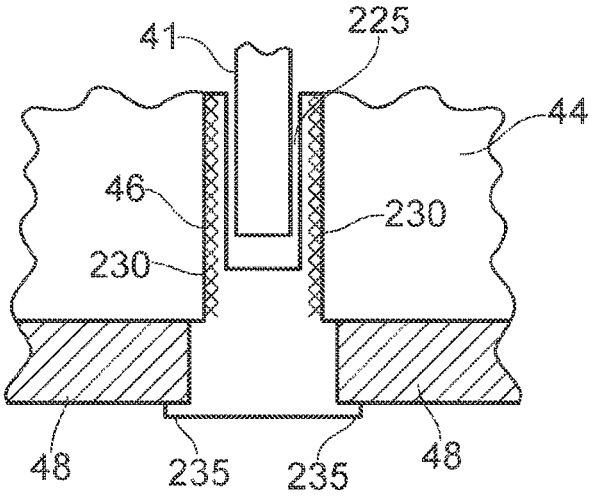
FIG. 8 schematically represents as a cross section view a portion of a cartridge for use with the control unit shown in FIG. 1 to form an aerosol provision system in accordance with certain embodiments of the disclosure.

A third modification to the cartridge 2 shown in FIGS. 1-6B is shown best with reference to FIG. 8, which shows a sectional view of a contact electrode 46 situated in the plug 44 and in the end cap 48 of the cartridge. In the case of FIG. 8, a recess 225 extends down from the top surface of the contact electrode 46 and accommodates a portion of the electrical lead 41 which provides power between the contact electrode and the heating element 40. To secure the portion of the electrical lead 41 located inside the recess 225, the contact electrode 46 may be crimped around the portion of the electrical electrical lead 41. Exemplary crimping operations will be described in further detail with reference to FIGS. 9A-9C. In the embodiment shown in FIG. 8, a portion of the contact electrode 46 may define a knurled outer surface 230 which is embedded in a portion of the cartridge for securing the contact electrode to the cartridge. In the case of FIG. 8, the knurled outer surface 230 is located at the interface of the contact electrode 46 with the plug 44. In the embodiments where the plug 44 is injection molded around the contact electrode 46, by introducing the knurled outer surface 230, this provides a greater surface area and thus a better adhesion force between the two components. In some embodiments, each contact electrode 46 may comprise a flange portion 235 which projects outwardly around the contact electrode 46, wherein the flange portion rests on a surface from the cartridge. Depending on the presence or not of the end cap 48, the flange portion 235 may rest on an end surface of the end cap 48, or on an end surface of the plug 44, (the end surface in each case being proximal the interface end of the cartridge). The presence of the flange portion 235 helps to support the contact electrode with respect to the plug 44, and also allows tools to more easily handle the contact electrode 46 during the forming process of the cartridge 200. The thickness of the flange portion will vary depending on the particular shape of cartridge 200, but in some embodiments may be less than 1 mm.

In the case of the contact electrode shown in in FIG. 8, the shape of the contact electrode 46 is such that contact electrode may be formed by a stamping process.

To provide a good conductive surface for each contact electrode, which is also less prone to corrosion in the event of ingress of aerosol/liquid contained elsewhere in the cartridge 200, each contact electrode 46 may be gold plated.

Figure 9A:
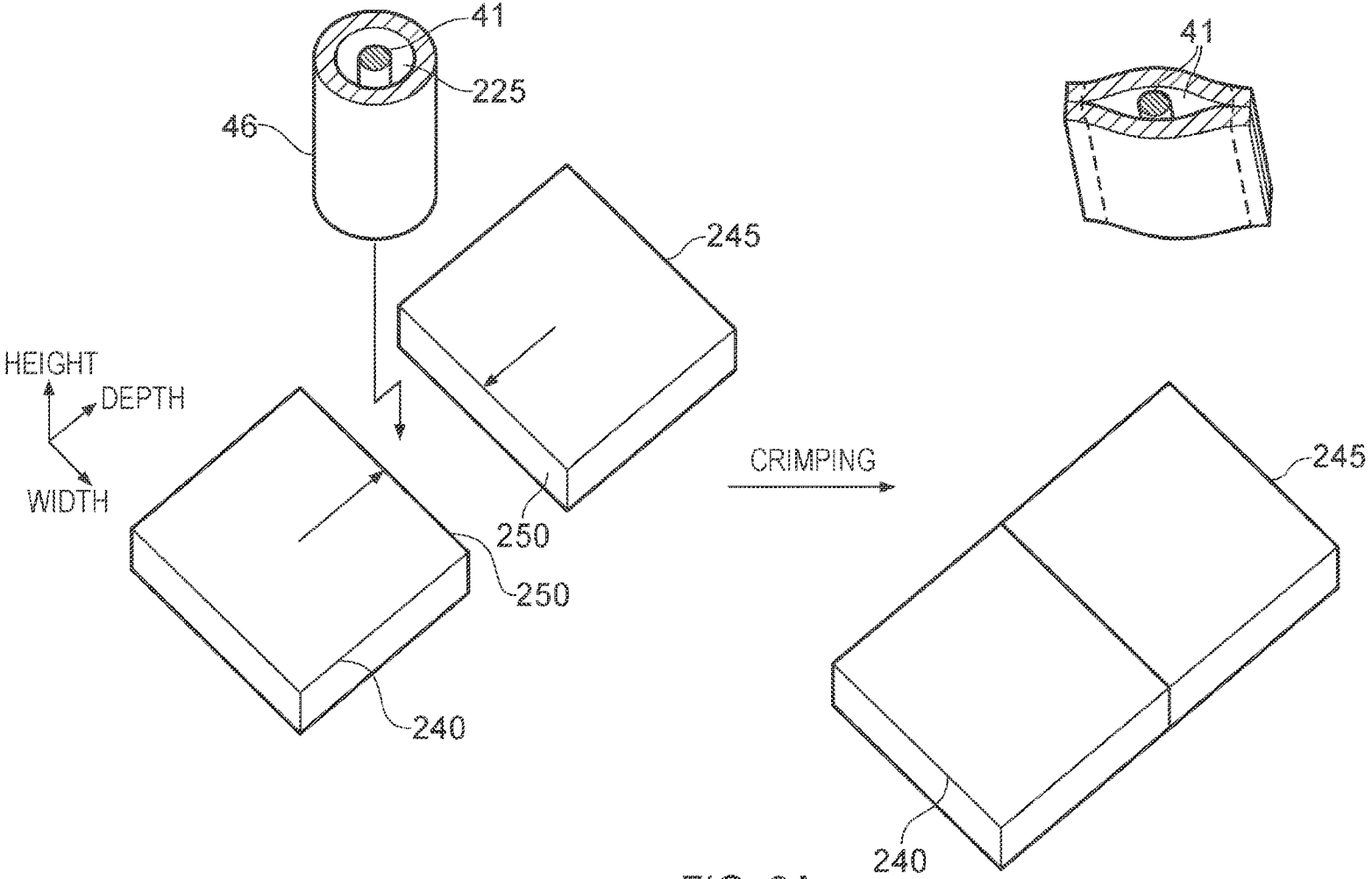
FIG. 9A schematically shows forming a crimped electrode in accordance with certain embodiments of the disclosure.
Figure 9C:
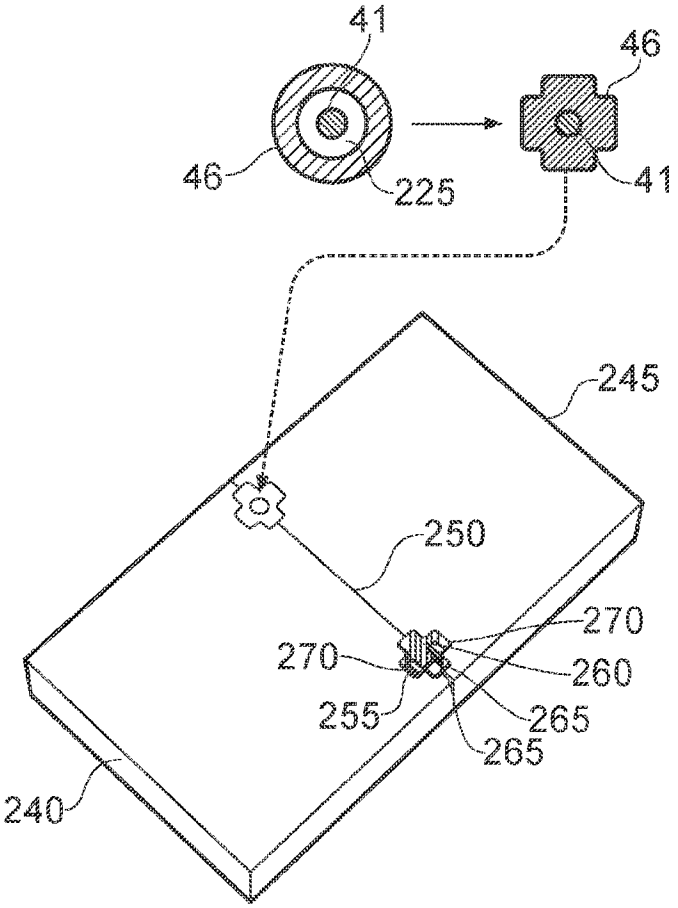
FIG. 9C schematically shows forming a crimped electrode in accordance with certain embodiments of the disclosure.
Figure 9B:
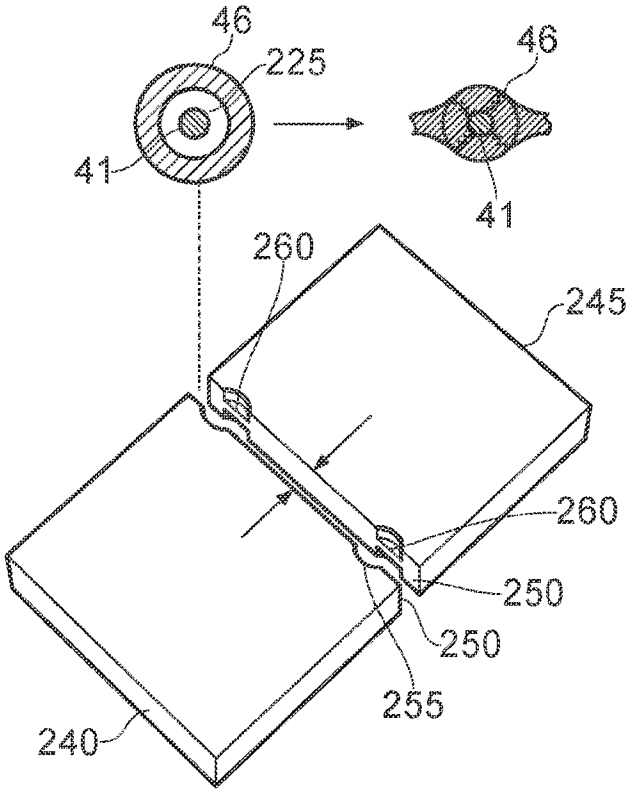
FIG. 9B schematically shows forming a crimped electrode in accordance with certain embodiments of the disclosure.

With reference to FIGS. 9A-9C, there is described various arrangements for forming a crimped contact electrode (such as the contact electrode 46).

In each of the embodiments of FIG. 9A-9C there is shown a first crimping member 240 and a second crimping member 245 which are configured to be moved together in a depth direction to crimp electrical lead 41 and a contact electrode 46, placed between the two crimping members, together. Each crimping member comprises a contact face 250 which extends across the width and the height of the crimping member, and the electrical lead 41 and the contact electrode 46 are placed concentrically between these two contact faces (the electrical lead 41 being placed within the recess 225 of the contact electrode 46). In the embodiment of FIG. 9A, the contact faces 250 are brought together in a depth direction perpendicular to the width and height of the first and second crimping members such that the contact electrode is deformed between the two contact faces and is crimped around the electrical lead 41. As a result of this crimping process, small voids (exaggerated in the above-right portion of FIG. 9A) may be created between the outside surface area of the electrical lead 41 and the contact electrode 46.

In some embodiments, located in the contact face 250 of the first crimping member 240 is a first recess 255 extending across the height of the crimping member and extending across a portion of the width of the crimping member. A corresponding second recess 260 is located in the contact face 250 of the second crimping member 245 such that the second recess extends across the height of the second crimping member and extends across a portion of the width of the second crimping member. In such embodiments, the electrical lead 41 and the contact electrode 46 are located between the two recesses 255;260 such that when the contact faces are brought together, the recesses crimp the contact electrode into a shape corresponding to the shape of the recesses 255;260

In some embodiments, such as FIG. 9B, the first recess is a first semi cylindrical recess, and the second recess is a second semi cylindrical recess. When the contact faces are engaged together, the two semi cylindrical recesses combine to form a cylindrical recess which extends in the height direction.

In other embodiments, such as FIG. 9C, the first recess is a first T-shaped recess, and the second recess is a second T-shaped recess. When the contact faces are engaged together, the two T-shaped recesses combine to form a recess having a plus-shaped cross section. Each T-shaped recess is defined by an elongate shoulder portion 265 which extends in the width direction of the crimping member in which the T-shaped recess is located, and an elongate leg portion 270 which extends perpendicular to the shoulder portion 265 in the depth direction of the crimping member. The edges from the first and/or second T-shaped recess which extend across the height of the corresponding crimping member may be chamfered (as shown in FIG. 9C).

With the provision of such recesses in the contact faces 250, this may reduce the extent of void formation between the outside surface area of the electrical lead 41 and the contact electrode 46 after the crimping process is complete. In some embodiments, after the crimping process, the extent of voids between the electrical lead 41 and the contact electrodes is such that at least 50%, at least 60%, at least 70%, at least 80%, at least 90% or at least 95% of the portion of the outside surface area of each electrical lead 41 which is located within the recess 225 of the contact electrode 46 is in contact with the contact electrode.

To impede axial slip of the electrical lead 41 with respect to the contact electrode 46, some or all of the recesses 255;260 from the contact faces 250 may comprise a protrusion 275 extending towards the contact face 250 of the crimping member in which the recess is located, wherein the protrusion 275 does not extend across the complete height of the recess. In some embodiments, the protrusion 275 may be located midway along the height of the recess in which the protrusion is located. In the embodiments where a T-shaped recess is employed, the protrusion 275 may be located at an end of the elongate leg portion 270. The size of any such protrusion 275 will depend on the application for the crimped component, however in some embodiments the maximum height of the protrusion may be no more than 5 mm.

With regards to other dimensions for the crimping members 240;245, in some embodiments the maximum height of each recess may be less than 30 mm; the maximum depth of each recess may be no more than 25 mm; and/or the maximum width of each recess may be no more than 50 mm.

Figure 10C:
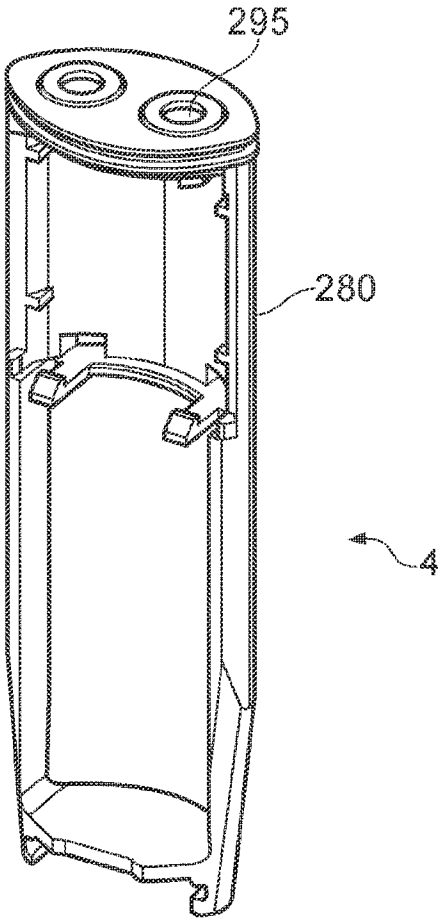
FIGS. 10B and 10C schematically shows a perspective view of individual components from the components shown in FIG. 10A.
Figure 10B:
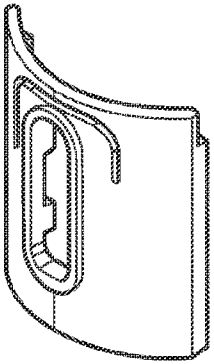
Figure 10A:
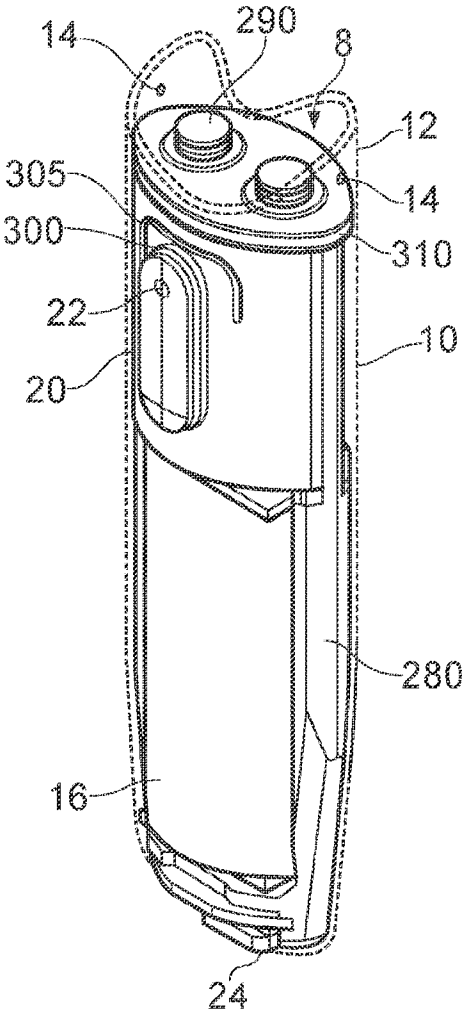
FIG. 10A schematically shows a perspective view of an interior for a control unit for use in an aerosol provision system in accordance with certain embodiments of the disclosure.

Turning to FIGS. 10A-10C, these relate to an interior for a control unit 4 for use in an aerosol provision system in accordance with certain embodiments of the disclosure. In the case of these Figures, outlined in dotted form in FIG. 10A is the outer housing 10 shown in FIG. 1 including the receptacle wall 12 that defines a receptacle 8 having an open first end 276 and a second end 278. A body 280 is configured to be inserted inside the receptacle 8 via the open first end 276 towards the second end 278. The body 280 is configured to hold the battery 16 and the control circuitry 18 as described in connection with FIG. 1. The body further comprises at least two contact electrodes 290, wherein each contact electrode 290 extends through a respective opening 295 in the body 280. Once the body 280 is located in the receptacle 8, and the cartridge 2 is at least partially within the receptacle 8, the contact electrodes 290 make contact with the corresponding contact electrodes 46 from the cartridge 2.

Located on the body 280 is a protrusion, in the form of the input button 20, which is configured to extend through a corresponding opening 281 in the receptacle wall 12 from the outer housing 10 when the body 280 is fully inserted inside the receptacle 8. The control unit 4 comprises at least one deformable portion 300 which is configured to deform as the body 280 is inserted into the receptacle 8 to allow the body 280 to be fully inserted into the receptacle 8, and to allow the protrusion (input button 20) to extend through the opening of the receptacle wall 12. In some embodiments, the deformation may be elastic deformation.

In the case of the embodiment shown in FIGS. 10A-10C, the body 280 comprises a slot 305 defining a cantilevered portion for the body 280, such that the cantilevered portion forms the deformable portion 300. The slot and/or the cantilevered portion may be situated anywhere on the control unit 4 as necessary to allow the input button 20 to deflect inwardly such that it and the body 280 can be passed down through the receptacle 8 via the open first end. In the embodiment shown in FIGS. 10A-10C, the body comprises a plate portion 310 on which is located the input button 20 and the slot 305. In that arrangement, extending around a portion of the input button 20 is the slot 305, such that the input button 20 is located on the cantilevered portion.

By virtue of the control unit 4 comprising the deformable portion 300, this allows the body to comprise an integral seal 310 which is located at the end of the body 280 more proximal the open first end than the second end of the receptacle 8 when the body 280 is fully inserted inside the receptacle 8. That is as opposed to a seal which is not integral, i.e. a separate seal which can only be attached to the body 280 once the body 280 has been fully inserted inside the receptacle 8, and after the input button 20 extends through the opening in the receptacle wall 12.

Thus in accordance with certain embodiments of the disclosure, a cartridge for an aerosol provision system may generally comprise a housing part having a mouthpiece end and an interface end, wherein the mouthpiece end includes an aerosol outlet for the cartridge and the interface end includes an interface for coupling the cartridge to a control unit. An air channel wall (which may be formed by various components of the cartridge) extends from an air inlet for the cartridge to the aerosol outlet via an aerosol generation region in the vicinity of a heating element. The cartridge has a reservoir within the housing part containing liquid for aerosolization. The reservoir is defined by a region within the housing part which is outside the air channel and an end of the reservoir at the interface end of the housing part is sealed by a resilient plug comprising a base part and an outer wall, wherein the outer wall of the resilient plug forms a seal with an inner surface of the housing part. Respective ends of a liquid transport element pass through opening in the air channel or into the reservoir so as to convey liquid from the reservoir to the heating element.

One aspect of some particular cartridge configurations in accordance with certain embodiments of the disclosure is the manner in which the resilient plug 44 provides a seal to the housing part 32. In particular, in accordance with some example implementations the outer wall 102 of the resilient plug 44 which seals to the inner surface of the housing part 32 to form the end of the liquid reservoir extends in direction parallel to the longitudinal axis of the cartridge to a position which is further from the interface end of the cartridge than the liquid transport element/heating element. That is to say, the ends of the liquid transport element extends into the liquid reservoir in a region which is surrounded by the outer sealing wall of the resilient plug. Not only does this help seal the reservoir against leakage, it allows the geometry of the reservoir in the region which supplies the liquid transport element with liquid to be governed by the geometry of the resilient plug. For example, the radial thickness of the reservoir in this region can readily be made smaller than the radial thickness in other longitudinal positions along the air channel, which can help trap liquid in the vicinity of the liquid transport element, thereby helping to reduce the risk of dry out for different orientations of the cartridge during use.

The outer wall of the resilient plug may, for example, contact the inner surface of the housing part at locations over a distance of at least 5 mm, 6 mm, 7 mm, 8 mm, 9 mm and 10 mm in a direction extending from the interface end to the mouthpiece end (i.e. parallel to the longitudinal axis). The outer wall of the resilient plug may be in contact with the inner surface of the housing over the majority of this distance, or the outer wall of the resilient plug may include a number of (e.g. four) circumferential ridges 140 to help improve sealing. The resilient plug may be slightly oversized relative to the opening in the housing part so that it is biased into slight compression. For example, for the implementation shown in FIG. 3B, the interior width of the housing part into which the resilient plug is inserted in the plane of this figure is around 17.5 mm, whereas the corresponding width of the resilient plug is around 18 mm, thereby placing the resilient plug into compression when inserted into the housing part. As can be most readily seen in FIGS. 5A to 5C, whereas the outer cross section of the cartridge housing part is symmetric under a 180° rotation, the resilient plug 44 does not have the same symmetry because it includes a flat 142 on one side to accommodate the gap 76 provided by the double-walled section 74 of the housing part (i.e. the resilient plug is asymmetric in a plane perpendicular to a longitudinal axis of the cartridge to accommodate the double-walled section of the housing part).

In terms of the radial size/width of the reservoir in the annular region where the liquid transport element extends into the reservoir, a distance between the air channel wall and the outer wall of the resilient plug in this region may, for example, be in the range 3 mm to 8 mm. In the example cartridge discussed above which has a generally oval housing part and a generally circular air channel, it will be appreciated the thickness of the reservoir is different at different locations around the air channel. In this example the liquid transport element is arranged to extend into the reservoir in the region where it is widest in the axial direction, i.e. into the "lobes" of the oval reservoir around the air channel. The portions of the liquid transport element that extend into the reservoir may, for example, have a length, as measured from the interior of the air channel wall, in the range 2 mm to 8 mm, e.g. in the range 3 mm to 7 mm or in the range 4 mm to 6 mm. The specific geometry in this regard (and for other aspects of the configuration) may be chosen having regard to a desired rate of liquid transport, for example having regard to the capillary strength of the liquid transport element and the viscosity of the liquid, and may be established for a given cartridge design through modelling or empirical testing.

Another aspect of some particular cartridge configurations in accordance with certain embodiments of the disclosure is the manner in which the air channel is routed through the cartridge, and in particular from the air inlet to the vicinity of the heating element (the aerosol generation region). In particular, whereas in a conventional cartridges an air inlet is typically provided at the interface end of the cartridge, in accordance with certain embodiments of the disclosure, an air inlet for the cartridge is located in a side wall of the housing part at a position which is further from the interface end than at least a part of the resilient plug that seals an end of the reservoir. Thus, the air channel in the cartridge is initially routed from the air inlet towards the interface end and bypasses the resilient plug before changing direction and entering the aerosol generation chamber through the resilient plug. This can allow the outer surface of the cartridge at the interface end, where it is closest to the heating element, to be closed, thereby helping to reduce the risk of leakage from the cartridge, both in terms of liquid coming through the openings in the air channel which is not retained by the liquid transport element in the air channel (e.g. due to saturation/agitation) or liquid that has being vaporized but condensed back to liquid in the air channel during use. In some implementations, a distance from air inlet to the interface end of the housing part may be at least 5 mm, 6 mm, 7 mm, 8 mm, 9 mm or 10 mm.

In some example implementations an absorbent element, for example a portion of sponge material or a series of channels forming a capillary trap, may be provided between the air inlet and the aerosol generation chamber, for example in the region air channel formed between the base of the resilient plug and the end cap, to further help reduce the risk of leakage by absorbing liquid that forms in the air channel and so helping prevent the liquid travelling around the air channel through the air inlet or towards the aerosol outlet.

In some example implementations the air channel from the air inlet to the aerosol outlet may have its smallest cross-sectional area where it passes through the hole 106 in the resilient plug. That is to say, the hole in the resilient plug may be primarily responsible for governing the overall resistance to draw for the electronic cigarette.

Another aspect of some particular cartridge configurations in accordance with certain embodiments of the disclosure is the manner in which the dividing wall element divides the air reservoir into two regions, namely a main region above the dividing wall (i.e. towards a mouthpiece end of the cartridge) and a liquid-supply region below the dividing wall (i.e. on the same side of the dividing wall as where the liquid transport element extends from the heating element into the reservoir). The dividing wall includes openings to govern the flow of liquid on the main region to the liquid supply region. The dividing wall can help retain liquid in the liquid supply region of the reservoir, example when the electronic cigarette is tilted through various orientations, which can help avoid dry out. The dividing wall can also conveniently provide a mechanical stop for the resilient plug to abut/press against so as to help correctly locate the resilient plug during assembly and maintain the resilient plug in slight compression between the dividing wall and the end cap when the cartridge is assembled.

In the example discussed above, the dividing wall is formed as a separate element form the housing part, wherein an inner surface of the housing part includes one or more protrusions arranged to contact the side of the dividing wall facing the mouthpiece end of the cartridge to locate the dividing wall along a longitudinal axis of the cartridge, but in other examples the dividing wall may be integrally formed with the housing part.

In the example discussed above the dividing wall is in the form of an annular band around the air channel and comprises four fluid communication openings 150 located in respective quadrants of the band. However, more or fewer openings through the dividing wall may be provided in different implementations. Individual openings may, for example, have an area of between 4 $mm^2$ and 15 $mm^2$.

A combined area for the at least one openings as a fraction of the total area of the dividing wall exposed to liquid supply region of the reservoir region may be, for example, from 20% to 80%; 30% to 70% or 40% to 60%.

It will be appreciated that while the above description has focused on some specific cartridge configurations comprising a number of different features, cartridges in accordance with other embodiments of the disclosure may not include all these features. For example, in some implementations an air path generally of the kind discussed above, i.e. with an air inlet which is in a sidewall of the cartridge and closer to the mouthpiece end of the cartridge than the heating element, may be provided in a cartridge which does not include a resilient plug with an outer sealing wall which extends around the heating element and/or does not include a dividing wall element of the kind discussed above. Similarly, a cartridge which does include a resilient plug with an outer sealing wall which extends around the heating element may have an air inlet into the cartridge which is at the interface end of the cartridge, and not in a sidewall, and which may also not have a dividing wall element of the kind discussed above. Furthermore, a cartridge which does include a dividing wall element, might not include an air inlet located further from the interface end of the cartridge than the heating element and/or an extended outer sealing wall for a resilient plug as discussed above.

Thus, there has been described a cartridge for an aerosol provision system comprising the cartridge and a control unit, wherein the cartridge comprises: a housing part having a mouthpiece end and an interface end, wherein the mouthpiece end includes an aerosol outlet for the cartridge and the interface end includes an interface for coupling the cartridge to the control unit; an air channel extending from an air inlet for the cartridge to the aerosol outlet, wherein the air channel is defined by an air channel wall; a reservoir within the housing part for liquid for aerosolization, wherein an end of the reservoir at the interface end of the housing part is sealed by a resilient plug comprising a base part and an outer wall extending away from the base part towards the mouthpiece end of the housing part, wherein the outer wall of the resilient plug forms a seal with an inner wall of the housing part; a heating element for heating liquid from the reservoir to generate aerosol in an aerosol generation region of the air channel for user inhalation; and a liquid transport element for transporting liquid from the reservoir to the heating element through an opening in the air channel wall, wherein the opening in the air channel wall is located nearer to the base part of the resilient plug than the top of the outer wall of the resilient plug so that a portion of the liquid transport element extends into the reservoir in a region surrounded by the outer wall of the resilient plug.

There has also been described a cartridge for an aerosol provision system comprising the cartridge and a control unit, wherein the cartridge comprises: a housing part having a mouthpiece end and an interface end connected by a side wall, wherein the mouthpiece end includes an aerosol outlet for the cartridge and the interface end includes an interface for coupling the cartridge to a control unit; an air channel extending from an air inlet for the cartridge to the aerosol outlet; a reservoir within the housing part containing liquid for aerosolization, wherein an end of the reservoir at the interface end of the housing part is sealed by a resilient plug, and wherein an outer wall of the resilient plug forms a seal with an inner surface of the housing part; a heating element for heating liquid from the reservoir to generate aerosol in an aerosol generation region of the air channel; and a liquid transport element for transporting liquid from the reservoir to the heating element; wherein the air inlet for the cartridge is located in the side wall of the housing part at a position which is further from the interface end than at least a part of the resilient plug.

There has also been described a cartridge for an aerosol provision system comprising the cartridge and a control unit, wherein the cartridge comprises: a housing part having a mouthpiece end and an interface end, wherein the mouthpiece end includes an aerosol outlet for the cartridge and the interface end includes an interface for coupling the cartridge to a control unit; an air channel extending from an air inlet in the housing part to the aerosol outlet; a reservoir within the housing part containing liquid for aerosolization, wherein an end of the reservoir at the interface end of the housing part is sealed by a resilient plug, wherein the reservoir includes a dividing wall between a first reservoir region on a side of the dividing wall facing the mouth piece end of the housing part and a second reservoir region on a side of the dividing wall facing the interface end of the housing part, wherein the dividing wall comprises at least one fluid communication opening to provide fluid communication between the first reservoir region and the second reservoir region; and a liquid transport element arranged to transport liquid from the second region of the reservoir to a heating element for generating aerosol in an aerosol generation region for user inhalation.

Also described are the embodiments as set out in the clauses at the end of this specification.

While the above described embodiments have in some respects focused on some specific example aerosol provision systems, it will be appreciated the same principles can be applied for aerosol provision systems using other technologies. That is to say, the specific manner in which various aspects of the aerosol provision system function, for example in terms of the underlying form of the heating element or heating element technology used are not directly relevant to the principles underlying the examples described herein.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

For instance, although the detailed description has been described with reference to a "liquid" in the cartridge/aerosol provision system, it will be appreciated that this liquid may be replaced with any aerosolizable material. Equally, where an aerosolizable material is used, it will be appreciated that in some embodiments this aerosolizable material may comprise a liquid.

First Set of Clauses

1. A cartridge for an aerosol provision system comprising the cartridge and a control unit, wherein the cartridge comprises:
   - a housing part having a mouthpiece end and an interface end, wherein the mouthpiece end includes an aerosol outlet for the cartridge and the interface end includes an interface for coupling the cartridge to a control unit;
   - an air channel extending from an air inlet in the housing part to the aerosol outlet;
   - a reservoir within the housing part containing liquid for aerosolising, wherein the reservoir includes a dividing wall element defining a dividing wall between a first reservoir region on a side of the dividing wall facing the mouth piece end of the housing part and a second reservoir region on a side of the dividing wall facing the interface end of the housing part, wherein the dividing wall comprises at least one fluid communication opening to provide fluid communication between the first reservoir region and the second reservoir region;
   - a liquid transport element arranged to transport liquid from the second region of the reservoir to a heating element for generating aerosol in an aerosol generation region for user inhalation;
   - an aerosol outlet tube, integrally formed with the dividing wall element, to provide a portion of the air channel between the aerosol generation region and the aerosol outlet.

2. The cartridge of clause 1, wherein the aerosol outlet tube extends beyond the dividing wall in a direction towards the mouthpiece end.

3. The cartridge of clause 1 or 2, wherein the dividing wall element is made of a plastic material.

4. The cartridge of any of clause 1 to 3, wherein the dividing wall element is made of polypropylene.

5. The cartridge of any of clause 1 to 4, wherein an end of the reservoir at the interface end of the housing part is sealed by a plug.

6. The cartridge of clause 5, wherein the aerosol outlet tube further comprises a slot which cooperates with a slot in the plug to form an opening in the air channel wall for the liquid transport element.

7. The cartridge of clause 5 or 6, wherein the dividing wall element is positioned in the cartridge to provide a stop for the plug such that the plug abuts the dividing wall element.

8 The cartridge of clause 5 or 6, wherein the plug comprises a base part and an outer wall extending away from the base part towards the mouthpiece end of the housing part, wherein a top surface of the outer wall abuts a peripheral part of the dividing wall element.

9. The cartridge of any of clauses 1 to 8, wherein the air channel passes through an air channel opening in the dividing wall element.

10. The cartridge of any of clauses 5 to 9, wherein the dividing wall element includes one or more projections extending away from the plane of the dividing wall towards the interface end of the cartridge which engage with one or more corresponding recesses in the plug.

11. The cartridge of any of clauses 5 to 10, wherein the dividing wall element includes one or more projections extending away from the plane of the dividing wall towards the interface end of the cartridge which engage with respective cradles formed in the plug to define a liquid transport element opening through which the liquid transport element passes.

12. The cartridge of any of clause 1 to 11, wherein the dividing wall element extends around the aerosol outlet tube.

13. The cartridge of any of clauses 1 to 12, wherein the liquid transport element comprises a capillary wick.

14. The cartridge of any of clauses 1 to 13, wherein the heating element comprises a heater.

15. The cartridge of any of clauses 1 to 14, wherein the liquid transport element and the heating element comprise a single integrated element.

16. An aerosol provision system comprising the cartridge of any one of clauses 1 to 15 and a control unit, wherein the control unit comprises a cartridge receiving section that includes an interface arranged to cooperatively engage with the interface at the interface end of the cartridge so as to releasably couple the cartridge to the control unit, wherein the control unit further comprises a power supply and control circuitry configured to selective supply power from the power supply to the heating element in the cartridge via their cooperatively engaging interfaces.

Second Set of Clauses

1. A cartridge for an aerosol provision system, wherein the cartridge comprises:
   - a heating element for heating liquid from a reservoir to generate aerosol in the aerosol generation region;

an air channel extending through the cartridge for delivering air to the heating element; and at least two contact electrodes mounted to the cartridge to allow power to be supplied to the heating element;

wherein each contact electrode comprises a portion defining a knurled outer surface which is embedded in a portion of the cartridge for securing the contact electrode to the cartridge.

2. A cartridge according to clause 1, wherein the cartridge further comprises:

a housing part having a mouthpiece end and an interface end, wherein the mouthpiece end includes the aerosol outlet for the cartridge and the interface end includes an interface for coupling the cartridge to a control unit;

wherein an end of the reservoir at the interface end of the housing part is sealed by a plug comprising a base part and an outer wall extending away from the base part towards the mouthpiece end of the housing part, wherein the outer wall of the plug forms a seal with an inner surface of the housing part;

wherein the portion of the cartridge is the plug.

3. A cartridge according to clause 2, wherein the plug is injection moulded around each contact electrode.

4. A cartridge according to any of clause 1 to 3, wherein at least one contact electrode further comprises a flange portion which projects outwardly around the contact electrode, wherein the flange portion rests on a surface from the cartridge.

5. A cartridge according to clause 4, wherein at least one contact electrode comprises no more than one flange portion which projects outwardly around the contact electrode, wherein the flange portion rests on a surface from the cartridge.

6. A cartridge according to clause 4 or 5, when further dependent on clause 2 or clause 3, wherein the surface from the cartridge is a surface from an end cap from the cartridge which is located at the interface end, or a surface from the plug.

7. A cartridge according to any of clause 4 to 6, wherein each flange portion has a thickness of no more than 1 mm.

8. A cartridge according to any of clause 1 to 7, wherein each contact electrode is gold plated.

9. A cartridge according to any of clause 1 to 8, wherein a portion of the air channel extends between the contact electrodes.

10. A cartridge according to any of clause 1 to 9, wherein the cartridge comprises no more than two contact electrodes.

11. An aerosol provision system comprising the cartridge of any one of clauses 1 to 10 and a control unit, wherein the control unit comprises a cartridge receiving section that includes an interface arranged to cooperatively engage with an interface from the cartridge so as to releasably couple the cartridge to the control unit, wherein the control unit further comprises a power supply and control circuitry configured to selective supply power from the power supply to the heating element in the cartridge via their cooperatively engaging interfaces.

Third Set of Clauses

1. A control unit for an aerosol provision system comprising a cartridge and the control unit, wherein the control unit comprises:

an outer housing including a receptacle wall that defines a receptacle having an open first end and a second end, wherein the receptacle wall comprises at least one opening;

a body configured to be inserted inside the receptacle via the open first end towards the second end, the body comprising a protrusion, wherein the protrusion is configured to extend through the opening when the body is fully inserted inside the receptacle;

wherein the control unit comprises at least one deformable portion which is configured to deform as the body is inserted into the receptacle to allow the body to be fully inserted into the receptacle, and to allow the protrusion to extend through the opening of the receptacle wall.

2. A control unit according to clause 1, wherein the deformable portion is configured to elastically deform as the body is inserted into the receptacle.

3. A control unit according to any of clause 1 or 2, wherein the body comprises the deformable portion.

4. A control unit according to clause 3, wherein the body comprises a slot defining a cantilevered portion for the body, wherein the cantilevered portion is the deformable portion.

5. A control unit according to clause 4, wherein the protrusion is located on the cantilevered portion.

6. A control unit according to any of clause 1 to 5, wherein the protrusion is a button for controlling an operation of the control unit.

7. A control unit according to any of clause 1 to 6, wherein the body comprises a battery and control circuitry for controlling the operation of the aerosol provision system.

8. A control unit according to any of clause 1 to 7, wherein the body comprises at least two contact electrodes, wherein each contact electrode extends through a respective opening in the body.

9. A control unit according to any of clause 1 to 8, wherein the outer housing is made of plastic.

10. A control unit according to any of clause 1 to 9, wherein the body comprises an integral seal, wherein the seal is located at an end of the body more proximal the open first end than the second end of the receptacle when the body is fully inserted inside the receptacle.

11. A provision system comprising a cartridge and the control unit of any of clause 1 to 10, wherein the cartridge comprises a heating element for heating liquid from a reservoir to generate aerosol in an aerosol generation region;

wherein the control unit comprises a cartridge receiving section that includes an interface arranged to cooperatively engage with the cartridge so as to releasably couple the cartridge to the control unit into a position where the cartridge is at least partially within the receptacle.

Fourth Set of Clauses

1. A cartridge for an aerosol provision system, wherein the cartridge comprises:

a heating element for heating liquid from a reservoir to generate aerosol in the aerosol generation region;

an air channel extending through the cartridge for delivering air to the heating element; and at least two contact electrodes mounted to the cartridge to allow power to be supplied to the heating element, wherein each contact electrode comprises a heating element lead for transferring power between the contact electrode and the heating element;

wherein a portion of each heating element lead is located inside a recess located in a portion of the contact electrode associated with the heating element lead;

wherein the portion of the contact electrode is crimped around the portion of the heating element lead to secure the portion of the contact electrode inside the recess.

2. A cartridge according to clause 1, wherein each contact electrode is gold plated.

3. A cartridge according to clause 1 or 2, wherein the crimped portion of each contact electrode comprises a circular cross section.

4. A cartridge according to clause 1 or 2, wherein the crimped portion of each contact electrode comprises a plus-shaped cross section.

5. A cartridge according to any of clause 1 to 4, wherein within each recess, at least 50% of the outside surface area of each heating element lead is in contact with the portion of the contact electrode.

6. A cartridge according to any of clause 1 to 5, wherein the maximum width of each contact electrode is less than 10 mm.

7. A method of crimping a first component around a second component between a pair of crimping members, wherein the pair of crimping members comprises:

a first crimping member comprising a first contact face which extends across the width and the height of the first crimping member, wherein a first recess extending across the height of the first crimping member and extending across a portion of the width of the first crimping member is located in the first contact face;

a second crimping member comprising a second contact face which extends across the width and the height of the second crimping member, wherein a second recess extending across the height of the second crimping member and extending across a portion of the width of the second crimping member is located in the second contact face;

wherein the method comprises the steps of:

placing the first and second components between the first and second contact faces, wherein the first component is located around the second component;

moving the contact faces together in a depth direction perpendicular to the width and height of the first and second crimping members such that the second component is deformed between the two contact faces, and such that the second component is crimped around the first component to secure the first and second components together.

8. A method according to clause 7, wherein the first recess is a first semi cylindrical recess, and the second recess is a second semi cylindrical recess.

9. A method according to clause 7, wherein the first recess is a first T-shaped recess, and the second recess is a second T-shaped recess.

10. A method of forming material according to clause 9, wherein the edges from the first T-shaped recess which extend across the height of the first crimping member are chamfered.

11. A method of forming material according to clause 9 or 10, wherein the edges from the second T-shaped recess which extend across the height of the second crimping member are chamfered.

12. A method of forming material according to any of clause 9 to 11, wherein each T-shaped recess is defined by an elongate shoulder portion which extends in the width direction of the crimping member in which the T-shaped recess is located, and an elongate leg portion which extends perpendicular to the shoulder portion in the depth direction of the crimping member.

13. A method according to any of clause 7 to 12, wherein each recess comprises a protrusion extending towards the contact face of the crimping member in which the recess is located, wherein the protrusion does not extend across the complete height of the recess.

14. A method of forming material according to clause 13, wherein the protrusion is located midway along the height of the recess in which the protrusion is located.

15. A method of forming material according to clause 13 or 14, wherein the maximum height of the protrusion is no more than 5 mm.

16. A method of forming material according to any of clause 13 to 15, when further dependent on clause 12, wherein the protrusion is located at an end of the elongate leg portion.

17. A method of forming material according to any of clause 7 to 16, wherein the maximum height of each recess is less than 30 mm.

18. A method of forming material according to any of clause 7 to 17, wherein the maximum depth of each recess is no more than 25 mm.

19. A method of forming material according to any of clause 7 to 18, wherein the maximum width of each recess is no more than 50 mm.

20. A method of forming material according to any of clause 7 to 19, wherein the first component is gold plated.

21. A method of forming material according to any of clause 7 to 20, wherein the first component is a heating element lead for transferring power between a contact electrode and the heating element, and wherein the second component is the contact electrode.

22. A cartridge according to any one of clauses 1-6, wherein each contact electrode and heating element lead are crimped together using the method according to clause 21.

Consistory Set of Clauses

1. A cartridge for an aerosol provision system comprising the cartridge and a control unit, wherein the cartridge comprises: an air channel extending from an air inlet for the cartridge to an outlet via an aerosol generation region; a heating element for heating liquid from a reservoir to generate aerosol in the aerosol generation region; a valve located in the air channel upstream of the aerosol-generating region; wherein the cartridge is configured such that air passing through the air channel is configured to pass from the air inlet, past the air valve, into the aerosol-generating region, and then out from the aerosol outlet.

2. A cartridge according to clause 1, wherein the valve is a one-way valve.

3. A cartridge according to any of clause 1 or 2, wherein the valve is a reed valve or a duckbill valve.

4. A cartridge according to any of clause 1 to 3, wherein the air channel is defined by an air channel wall, and wherein the cartridge further comprises: a housing part having a mouthpiece end and an interface end, wherein the mouthpiece end includes the aerosol outlet for the cartridge and the interface end includes an interface for coupling the cartridge to the control unit; a reservoir within the housing part containing liquid for aerosolization, and a liquid transport element for transporting liquid from the reservoir to the heating element through an opening in the air channel wall.

5. A cartridge according to clause 4, wherein an end of the reservoir at the interface end of the housing part is sealed by a plug comprising a base part and an outer wall extending away from the base part towards the mouthpiece end of the housing part, wherein the outer wall of the plug forms a seal with an inner surface of the housing part; wherein a portion of the air channel extends through the plug.

6. A cartridge according to clause 5, wherein the valve is integrally formed with the plug.

7. A cartridge according to any of clauses 4 to 6, wherein the valve tapers inwardly in a direction extending away from the interface end.

8. A cartridge according to any of clauses 1 to 7, wherein the valve tapers inwardly inside the aerosol-generating region.

9. A cartridge according to any of clauses 1 to 8, wherein the valve projects inside the aerosol-generating region.

10. A cartridge according to any of clauses 1 to 9, wherein the valve is orientated inside the cartridge such that the air passing through the valve extends in a direction which is substantially parallel to the direction of aerosol passing through the aerosol outlet.

11. The cartridge according to any of clauses 1 to 10, further comprising a aerosol outlet tube, extending between the aerosol-generating region and the aerosol outlet, for directing aerosol generated in the aerosol-generating region through to the aerosol outlet.

12. An aerosol provision system comprising the cartridge of any one of clauses 1 to 11 and a control unit, wherein the control unit comprises a cartridge receiving section that includes an interface arranged to cooperatively engage with the cartridge so as to releasably couple the cartridge to the control unit, wherein the control unit further comprises a power supply and control circuitry configured to selective supply power from the power supply to the heating element in the cartridge via their cooperatively engaging interfaces.

13. A method of generating aerosol from a cartridge for an aerosol provision system, wherein the cartridge comprises: an aerosol outlet; an air channel extending from an air inlet for the cartridge to the aerosol outlet via an aerosol generation region; and a heating element for heating liquid from a reservoir to generate aerosol in the aerosol generation region; a valve located in the air channel upstream of the aerosol-generating region; wherein the method comprises passing air through the air channel from the air inlet, past the air valve, into the aerosol-generating region, and then out from the aerosol outlet.

14. A method according to clause 13, wherein the cartridge further comprises: a reservoir within the housing part containing liquid for aerosolizing; and a liquid transport element for transporting liquid from the reservoir to the heating element, wherein the method further comprises passing liquid from the reservoir via the liquid transport element, and forming aerosol inside the aerosol-generating region; wherein the valve is configured to inhibit aerosol generated inside the aerosol-generating region from flowing through the air channel back towards the air inlet.

15. A cartridge for an aerosol provision system comprising the cartridge and a control unit, wherein the cartridge comprises: a housing part having a mouthpiece end and an interface end, wherein the mouthpiece end includes an aerosol outlet for the cartridge and the interface end includes an interface for coupling the cartridge to a control unit; an air channel extending from an air inlet in the housing part to the aerosol outlet; a reservoir within the bousing part containing liquid for aerosolizing, wherein the reservoir includes a dividing wall element defining a dividing wall between a first reservoir region on a side of the dividing wall facing the mouth piece end of the housing part and a second reservoir region on a side of the dividing wall facing the interface end of the housing part, wherein the dividing wall comprises at least one fluid communication opening to provide fluid communication between the first reservoir region and the second reservoir region: a liquid transport element arranged to transport liquid from the second region of the reservoir to a heating element for generating aerosol in an aerosol generation region for user inhalation; an aerosol outlet tube, integrally formed with the dividing wall element, to provide a portion of the air channel between the aerosol generation region and the aerosol outlet.

16. The cartridge of clause 15, wherein the aerosol outlet tube extends beyond the dividing wall in a direction towards the mouthpiece end.

17. The cartridge of clause 15 or 16, wherein the dividing wall element is made of a plastic material.

18. The cartridge of any of clause 15 to 17, wherein the dividing wall element is made of polypropylene.

19. The cartridge of any of clause 15 to 18, wherein an end of the reservoir at the interface end of the housing part is sealed by a plug.

20. The cartridge of clause 19, wherein the aerosol outlet tube further comprises a slot which cooperates with a slot in the plug to form an opening in the air channel wall for the liquid transport element.

21. The cartridge of clause 19 or 20, wherein the dividing wall element is positioned in the cartridge to provide a stop for the plug such that the plug abuts the dividing wall element.

22. The cartridge of clause 19 or 20, wherein the plug comprises a base part and an outer wall extending away from the base part towards the mouthpiece end of the housing part, wherein a top surface of the outer wall abuts a peripheral part of the dividing wall element.

23 The cartridge of any of clauses 15 to 22, wherein the air channel passes through an air channel opening in the dividing wall element.

24. The cartridge of any of clauses 19 to 23, wherein the dividing wall element includes one or more projections extending away from the plane of the dividing wall towards the interface end of the cartridge which engage with one or more corresponding recesses in the plug.

25. The cartridge of any of clauses 19 to 24, wherein the dividing wall element includes one or more projections extending away from the plane of the dividing wall towards the interface end of the cartridge which engage with respective cradles formed in the plug to define a liquid transport element opening through which the liquid transport element passes.

26. The cartridge of any of clauses 15 to 25, wherein the dividing wall element extends around the aerosol outlet tube.

27 The cartridge of any of clauses 15 to 26, wherein the liquid transport element comprises a capillary wick.

28 The cartridge of any of clauses 15 to 27, wherein the heating element comprises a heater.

29 The cartridge of any of clauses 15 to 28, wherein the liquid transport element and the heating element comprise a single integrated element.

30. An aerosol provision system comprising the cartridge of any one of clauses 15 to 29 and a control unit, wherein the control unit comprises a cartridge receiving section that includes an interface arranged to cooperatively engage with the interface at the interface end of the cartridge so as to releasably couple the cartridge to the control unit, wherein the control unit further comprises a power supply and control circuitry configured to selective supply power from the power supply to the heating element in the cartridge via their cooperatively engaging interfaces.

31. A cartridge for an aerosol provision system, wherein the cartridge comprises: a heating element for heating liquid from a reservoir to generate aerosol in the aerosol generation region, an air channel extending through the cartridge for delivering air to the beating element; and at least two contact electrodes mounted to the cartridge to allow power to be supplied to the heating element: wherein each contact electrode comprises a portion defining a knurled outer surface, which is embedded in a portion of the cartridge for securing the contact electrode to the cartridge.

32. A cartridge according to clause 31, wherein the cartridge further comprises: a housing part having a mouthpiece end and an interface end, wherein the mouthpiece end includes the aerosol outlet for the cartridge and the interface end includes an interface for coupling the cartridge to a control unit; wherein an end of the reservoir at the interface end of the housing part is sealed by a plug comprising a base part and an outer wall extending away from the base part towards the mouthpiece end of the housing part, wherein the outer wall of the plug forms a seal with an inner surface of the housing part; wherein the portion of the cartridge is the plug.

33. A cartridge according to clause 32, wherein the plug is injection molded around each contact electrode.

34. A cartridge according to any of clause 31 to 33, wherein at least one contact electrode further comprises a flange portion which projects outwardly around the contact electrode, wherein the flange portion rests on a surface from the cartridge.

35. A cartridge according to clause 34, wherein at least one contact electrode comprises no more than one flange portion which projects outwardly around the contact electrode, wherein the flange portion rests on a surface from the cartridge.

36. A cartridge according to clause 34 or 35, when further dependent on clause 32 or clause 33, wherein the surface from the cartridge is a surface from an end cap from the cartridge which is located at the interface end, or a surface from the plug.

37. A cartridge according to any of clause 34 to 36, wherein each flange portion has a thickness of no more than 1 mm.

38. A cartridge according to any of clause 31 to 37, wherein each contact electrode is gold plated.

39. A cartridge according to any of clause 31 to 38, wherein a portion of the air channel extends between the contact electrodes.

40. A cartridge according to any of clause 31 to 39, wherein the cartridge comprises no more than two contact electrodes.

41. An aerosol provision system comprising the cartridge of any one of clauses 31 to 40 and a control unit, wherein the control unit comprises a cartridge receiving section that includes an interface arranged to cooperatively engage with an interface from the cartridge so as to releasably couple the cartridge to the control unit, wherein the control unit further comprises a power supply and control circuitry configured to selective supply power from the power supply to the heating element in the cartridge via their cooperatively engaging interfaces.

42. A control unit for an aerosol provision system comprising a cartridge and the control unit, wherein the control unit comprises: an outer housing including a receptacle wall that defines a receptacle having an open first end and a second end, wherein the receptacle wall comprises at least one opening; a body configured to be inserted inside the receptacle via the open first end towards the second end, the body comprising a protrusion, wherein the protrusion is configured to extend through the opening when the body is fully inserted inside the receptacle; wherein the control unit comprises at least one deformable portion which is configured to deform as the body is inserted into the receptacle to allow the body to be fully inserted into the receptacle, and to allow the protrusion to extend through the opening of the receptacle wall.

43. A control unit according to clause 42, wherein the deformable portion is configured to elastically deform as the body is inserted into the receptacle.

44. A control unit according to any of clause 42 or 43, wherein the body comprises the deformable portion.

45. A control unit according to clause 44, wherein the body comprises a slot defining a cantilevered portion for the body, wherein the cantilevered portion is the deformable portion.

46. A control unit according to clause 45, wherein the protrusion is located on the cantilevered portion.

47. A control unit according to any of clause 42 to 46, wherein the protrusion is a button for controlling an operation of the control unit.

48. A control unit according to any of clause 42 to 47, wherein the body comprises a battery and control circuitry for controlling the operation of the aerosol provision system.

49. A control unit according to any of clause 42 to 48, wherein the body comprises at least two contact electrodes, wherein each contact electrode extends through a respective opening in the body.

50. A control unit according to any of clause 42 to 49, wherein the outer housing is made of plastic.

51. A control unit according to any of clause 42 to 50, wherein the body comprises an integral seal, wherein the seal is located at an end of the body more proximal the open first end than the second end of the receptacle when the body is fully inserted inside the receptacle.

52. A provision system comprising a cartridge and the control unit of any of clause 42 to 51, wherein the cartridge comprises a heating element for heating liquid from a reservoir to generate aerosol in an aerosol generation region; wherein the control unit comprises a cartridge receiving section that includes an interface arranged to cooperatively engage with the cartridge so as to releasably couple the cartridge to the control unit into a position where the cartridge is at least partially within the receptacle.

53. A cartridge for an aerosol provision system, wherein the cartridge comprises: a heating element for heating liquid from a reservoir to generate aerosol in the aerosol generation region; an air channel extending through the cartridge for delivering air to the heating element; and at least two contact electrodes mounted to the cartridge to allow power to be supplied to the heating element, wherein each contact electrode comprises a heating element lead for transferring power between the contact electrode and the heating element; wherein a portion of each heating element lead is located inside a recess located in a portion of the contact electrode associated with the heating element lead; wherein the portion of the contact electrode is crimped around the portion of the heating element lead to secure the portion of the contact electrode inside the recess.

54. A cartridge according to clause 53, wherein each contact electrode is gold plated.

55. A cartridge according to clause 53 or 54, wherein the crimped portion of each contact electrode comprises a circular cross section.

56. A cartridge according to clause 53 or 54, wherein the crimped portion of each contact electrode comprises a plus-shaped cross section.

57. A cartridge according to any of clause 53 to 56, wherein within each recess, at least 50% of the outside surface area of each heating element lead is in contact with the portion of the contact electrode.

58. A cartridge according to any of clause 53 to 57, wherein the maximum width of each contact electrode is less than 10 mm.

59. A method of crimping a first component around a second component between a pair of crimping members, wherein the pair of crimping members comprises: a first crimping member comprising a first contact face which extends across the width and the height of the first crimping member, wherein a first recess extending across the height of the first crimping member and extending across a portion of the width of the first crimping member is located in the first contact face; a second crimping member comprising a second contact face which extends across the width and the height of the second crimping member, wherein a second recess extending across the height of the second crimping member and extending across a portion of the width of the second crimping member is located in the second contact face; wherein the method comprises: placing the first and second components between the first and second contact faces, wherein the first component is located around the second component; moving the contact faces together in a depth direction perpendicular to the width and height of the first and second crimping members such that the second component is deformed between the two contact faces, and such that the second component is crimped around the first component to secure the first and second components together.

60. A method according to clause 59, wherein the first recess is a first semi cylindrical recess, and the second recess is a second semi cylindrical recess.

61. A method according to clause 59, wherein the first recess is a first T-shaped recess, and the second recess is a second T-shaped recess.

62. A method of forming material according to clause 61, wherein the edges from the first T-shaped recess which extend across the height of the first crimping member are chamfered.

63. A method of forming material according to clause 61 or 62, wherein the edges from the second T-shaped recess which extend across the height of the second crimping member are chamfered.

64. A method of forming material according to any of clause 61 to 63, wherein each T-shaped recess is defined by an elongate shoulder portion which extends in the width direction of the crimping member in which the T-shaped recess is located, and an elongate leg portion which extends perpendicular to the shoulder portion in the depth direction of the crimping member.

65. A method according to any of clause 59 to 64, wherein each recess comprises a protrusion extending towards the contact face of the crimping member in which the recess is located, wherein the protrusion does not extend across the complete height of the recess.

66. A method of forming material according to clause 65, wherein the protrusion is located midway along the height of the recess in which the protrusion is located.

67. A method of forming material according to clause 65 or 66, wherein the maximum height of the protrusion is no more than 5 mm.

68. A method of forming material according to any of clause 65 to 67, when further dependent on clause 64, wherein the protrusion is located at an end of the elongate leg portion.

69. A method of forming material according to any of clause 59 to 68, wherein the maximum height of each recess is less than 30 mm.

70. A method of forming material according to any of clause 59 to 69, wherein the maximum depth of each recess is no more than 25 mm.

71. A method of forming material according to any of clause 59 to 70, wherein the maximum width of each recess is no more than 50 mm.

72. A method of forming material according to any of clause 59 to 71, wherein the first component is gold plated.

73. A method of forming material according to any of clause 59 to 72, wherein the first component is a heating element lead for transferring power between a contact electrode and the heating element, and wherein the second component is the contact electrode.

74. A cartridge according to any one of clauses 53-58, wherein each contact electrode and heating element lead are crimped together using the method according to clause 73.

The invention claimed is:

1. A cartridge for an aerosol provision system, the cartridge comprising:

a reservoir;

a heating element for heating liquid from the reservoir to generate aerosol;

a housing part comprising the reservoir, the heating element and an air channel extending through the housing part of the cartridge for delivering air to the heating element, wherein the housing part has a mouthpiece end and an interface end, wherein the mouthpiece end includes an aerosol outlet for the cartridge and the interface end includes an interface for coupling the cartridge to a control unit of the aerosol provision system, wherein an end of the reservoir at the interface end of the housing part is sealed by a plug comprising a base part and an outer wall extending away from the base part towards the mouthpiece end of the housing part, wherein the outer wall of the plug forms a seal with an inner surface of the housing part; and two contact electrodes mounted to the cartridge to allow power to be supplied to the heating element, wherein the cartridge comprises no more than two contact electrodes, wherein each contact electrode further comprises a flange portion which projects outwardly around the contact electrode, wherein the flange portion rests on a surface from the cartridge, wherein a portion of the air channel extends between the two contact electrodes, and wherein the surface from the cartridge is a surface from an end cap from the cartridge, which is located at the interface end.

2. The cartridge according to claim 1, wherein the end cap is molded with the electrodes mounted therein.

3. The cartridge according to claim 1, wherein the surface from the cartridge is a surface from the plug.

4. The cartridge according to claim 1, wherein each contact electrode comprises an upper end including a chamfer.

5. The cartridge according to claim 1, wherein each flange portion has a thickness of no more than 1 mm.

6. The cartridge according to claim 1, wherein each contact electrode is gold plated.

7. The cartridge according to claim 1, wherein the maximum width of each contact electrode is less than 10 mm.

8. The cartridge according to claim 1, wherein the cartridge further comprises a liquid transport element for transporting the liquid from the reservoir to the heating element.

9. The cartridge according to claim 8, wherein the liquid transport element and the heating element comprise a single integrated element.

10. The cartridge according to claim 8, wherein the liquid transport element comprises a ceramic material.

11. The cartridge according to claim 1, further comprising an aerosol outlet tube extending between the heating element and the aerosol outlet, for directing aerosol generated by the heating element through to the aerosol outlet.

12. The cartridge according to claim 11, wherein the reservoir surrounds the aerosol outlet tube.

13. The cartridge according to claim 1, wherein the flange portion of each contact electrode projects outwardly from the contact electrode in a direction which is perpendicular to a longitudinal axis of the contact electrode.

14. The cartridge according to claim 1, wherein the flange portion of each contact electrode projects outwardly from the contact electrode in a direction which is perpendicular to a longitudinal axis of the cartridge.

15. The cartridge according to claim 1, wherein each contact electrode comprises an electrode post.

16. An aerosol provision system comprising the cartridge of claim 1 and the control unit, wherein the control unit comprises a cartridge receiving section that includes an interface arranged to cooperatively engage with an interface from the cartridge so as to releasably couple the cartridge to the control unit, wherein the control unit further comprises a power supply and control circuitry configured to selective supply power from the power supply to the heating element in the cartridge via their cooperatively engaging interfaces.

* * * * *